US011835889B2

(12) United States Patent
Miyamoto et al.

(10) Patent No.: US 11,835,889 B2
(45) Date of Patent: Dec. 5, 2023

(54) IMAGE FORMING APPARATUS

(71) Applicant: FUJIFILM Business Innovation Corp., Tokyo (JP)

(72) Inventors: Yoko Miyamoto, Ebina (JP); Takashi Hoshino, Yokohama (JP); Shinji Okuyama, Ebina (JP); Tomoaki Yoshioka, Ebina (JP); Toshiaki Baba, Ebina (JP); Chihiro Iijima, Yokohama (JP)

(73) Assignee: FUJIFILM Business Innovation Corp., Tokyo (JP)

( * ) Notice: Subject to any disclaimer, the term of this patent is extended or adjusted under 35 U.S.C. 154(b) by 0 days.

(21) Appl. No.: 17/715,242

(22) Filed: Apr. 7, 2022

(65) Prior Publication Data

US 2022/0229384 A1 Jul. 21, 2022

Related U.S. Application Data

(63) Continuation of application No. PCT/JP2020/029609, filed on Aug. 3, 2020.

(30) Foreign Application Priority Data

Feb. 26, 2020 (JP) ..... 2020-030520

(51) Int. Cl.
*G03G 15/16* (2006.01)
*G03G 15/01* (2006.01)
(Continued)

(52) U.S. Cl.
CPC ..... *G03G 15/1615* (2013.01); *G03G 15/0131* (2013.01); *G03G 15/2007* (2013.01); *G03G 15/55* (2013.01); *G03G 15/70* (2013.01)

(58) Field of Classification Search
CPC ..... G03G 15/0131; G03G 15/0136; G03G 15/161; G03G 15/1615; G03G 15/55;
(Continued)

(56) References Cited

U.S. PATENT DOCUMENTS 3,979,161 A 9/1976 Kremer et al.
3,980,863 A * 9/1976 Wulz ..... G03G 15/2007 432/59
(Continued)

FOREIGN PATENT DOCUMENTS

JP S53-032743 U 3/1978
JP S56-038071 A 4/1981
(Continued)

OTHER PUBLICATIONS

Sep. 8, 2020 International Search Report issued in International Patent Application No. PCT/JP2020/029609.
(Continued)

*Primary Examiner* — Carla J Therrien
(74) *Attorney, Agent, or Firm* — Oliff PLC

(57) ABSTRACT

An image forming apparatus includes: a colorant image former; an image holder configured to hold a colorant image formed by the colorant image former and to be rotationally driven; a transfer member configured to transfer the colorant image onto a recording medium, which is transported from an upstream side, by sandwiching the recording medium between the transfer member and the image holder, and rotationally driving the transfer member to transport the recording medium to a downstream side; and a contact-and-separation mechanism configured to relatively contact or separate the image holder and the transfer member, in which, in response to an abnormality being detected, the image forming apparatus operates in a mode in which the contact-and-separation mechanism relatively separates the image
(Continued)

holder and the transfer member, and then rotational driving of the transfer member is stopped after rotational driving of the image holder is stopped.

14 Claims, 19 Drawing Sheets

(51) Int. Cl.
*G03G 15/20* (2006.01)
*G03G 15/00* (2006.01)

(58) Field of Classification Search
CPC .... G03G 15/70; G03G 15/703; G03G 15/706; G03G 21/1638; G03G 2215/00548; G03G 2221/1675
See application file for complete search history.

(56) References Cited

U.S. PATENT DOCUMENTS

| | | | | |
|---|---|---|---|---|
| 5,521,688 | A * | 5/1996 | Moser | G03G 15/6585 399/335 |
| 2003/0156298 | A1* | 8/2003 | Matsuyama | G03G 15/70 358/1.1 |
| 2004/0161252 | A1* | 8/2004 | Hirai | G03G 15/70 399/21 |
| 2004/0184824 | A1* | 9/2004 | Hirai | G03G 15/70 399/21 |
| 2009/0116888 | A1* | 5/2009 | Kladias | G03G 15/2039 399/400 |
| 2009/0148202 | A1 | 6/2009 | Aiba | |
| 2010/0080597 | A1 | 4/2010 | Seki et al. | |
| 2012/0039643 | A1* | 2/2012 | Chang | G03G 15/2007 399/328 |
| 2012/0099881 | A1 | 4/2012 | Seki et al. | |
| 2014/0205308 | A1* | 7/2014 | Kamoda | G03G 15/2021 399/69 |

FOREIGN PATENT DOCUMENTS

| | | | |
|---|---|---|---|
| JP | H06-138727 | A | 5/1994 |
| JP | H07-295419 | A | 11/1995 |
| JP | 2003-140488 | A | 5/2003 |
| JP | 2008-046227 | A | 2/2008 |
| JP | 2009-139670 | A | 6/2009 |
| JP | 2010-204493 | A | 9/2010 |
| JP | 2011-186197 | A | 9/2011 |
| JP | 5538788 | B2 | 7/2014 |
| JP | 2014-186077 | A | 10/2014 |

OTHER PUBLICATIONS

Sep. 8, 2020 Written Opinion of the International Searching Authority issued in International Patent Application No. PCT/JP2020/029609.
Sep. 19, 2023 Office Action issued in Japanese Patent Application No. 2020-030520.

* cited by examiner

IMAGE FORMING APPARATUS

CROSS-REFERENCE TO RELATED APPLICATIONS

This is a continuation of International Application No. PCT/JP2020/029609 filed on Aug. 3, 2020, and claims priority from Japanese Patent Application No. 2020-030520 filed on Feb. 26, 2020.

BACKGROUND

Technical Field

The present invention relates to an image forming apparatus.

Related Art

JP-A-2003-140488 discloses an image forming apparatus such as an electrophotographic apparatus or an electrostatic recording apparatus including an image heating device, and the image heating device. In the related art, the image forming apparatus includes a fixing device that forms a fixing nip unit by pressing a fixing roller and a pressurizing member that are rotatably disposed to each other, and fixes, by the fixing nip unit, a toner image to a transfer material while gripping and transporting the transfer material to which the toner image is transferred. The image forming apparatus includes a stop mode in which a transfer material transporting operation stop timing to the fixing device and a transfer material transporting operation stop timing of the fixing device are different.

JP-A-2009-139670 discloses an image forming apparatus capable of switching between a full-color mode and a black monochrome mode, and more specifically, control for improving a transfer performance in a black monochrome mode without impairing a transfer performance in a full-color mode. In the related art, in the black monochrome mode, an intermediate transfer belt is separated from a photoconductive drum on an upstream side in a state where the photosensitive drum is in contact with the intermediate transfer belt. At this time, a tension roller is raised in interlocking with a contact-separation mechanism, and a winding angle of the intermediate transfer belt with respect to the photoconductive drum is made larger than that in the full-color mode. On the other hand, in the full-color mode, the tension roller is lowered, and separated from an inner surface of the intermediate transfer belt.

Japanese Patent No. 5538788 discloses an image forming apparatus such as a copying machine or a printer that performs image formation by an electrophotographic method. In the related art, the image forming apparatus includes an image carrier that carries a toner image, a belt that transfers the toner image formed on the image carrier to a transfer material, and a transfer member that is separable from the belt. When the transfer member is to be separated from the belt, the transfer member is separated from the belt after the belt rotating at a first speed is changed to a second speed lower than the first speed.

SUMMARY

When an abnormality such as a jam of a recording medium is detected and an image forming apparatus is to be stopped, it may be desired to continue rotational driving of a transfer member even if the abnormality is detected and to stop the image forming apparatus after the recording medium is transported to a downstream side in order to easily remove the recording medium.

However, when an image holder such as an intermediate transfer belt is in contact with the transfer member, rotational driving of the image holder is also continued until the rotational driving of the transfer member is stopped, so that a load on the image holder is increased.

Aspects of non-limiting embodiments of the present disclosure relate to stopping, when an abnormality is detected and an image forming apparatus is to be stopped, rotational driving of an image holder at an early stage as compared with a case where the transfer member and the image holder are in contact with each other until the rotational driving of the transfer member is stopped.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided an image forming apparatus including: a colorant image former; an image holder configured to hold a colorant image formed by the colorant image former and to be rotationally driven; a transfer member configured to transfer the colorant image onto a recording medium, which is transported from an upstream side, by sandwiching the recording medium between the transfer member and the image holder, and rotationally driving the transfer member to transport the recording medium to a downstream side; and a contact-and-separation mechanism configured to relatively contact or separate the image holder and the transfer member, in which, in response to an abnormality being detected, the image forming apparatus operates in a mode in which the contact-and-separation mechanism relatively separates the image holder and the transfer member, and then rotational driving of the transfer member is stopped after rotational driving of the image holder is stopped.

BRIEF DESCRIPTION OF DRAWINGS

Exemplary embodiment(s) of the present invention will be described in detail based on the following figures, wherein.

DETAILED DESCRIPTION

First Exemplary Embodiment

An example of an image forming apparatus according to a first exemplary embodiment of the present invention will be described.

[Apparatus Configuration]

First, an apparatus configuration of the image forming apparatus will be described.

(Overall Configuration of Image Forming Apparatus)

Figure 1:
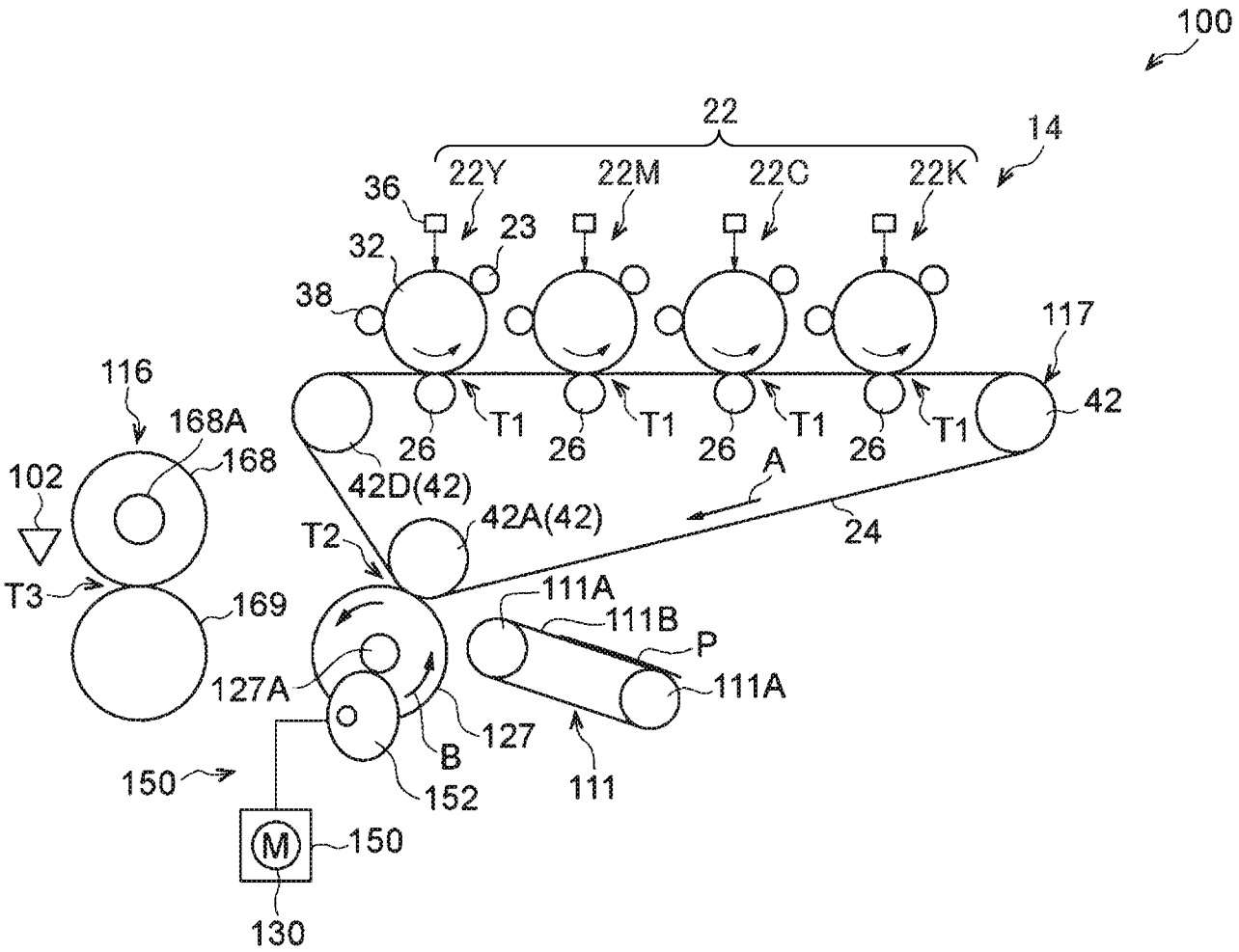
FIG. 1 is a schematic view of an image forming apparatus according to a first exemplary embodiment.

An image forming apparatus 100 shown in FIG. 1 is an example of an image forming apparatus that forms an image on a recording medium. The image forming apparatus 100 is an electrophotographic image forming apparatus that forms a toner image as an example of a colorant image on a recording medium P such as a sheet. Specifically, the image forming apparatus 100 includes an image forming unit 14, a first transport body 11, and a fixing device 116. Hereinafter, a configuration of each unit of the image forming apparatus 100 will be described.

(Image Forming Unit)

The image forming unit 14 is an example of a forming unit that forms an image on a recording medium. Specifically, the image forming unit 14 has a function of forming a toner image to the recording medium P as an example of a material to be transported. More specifically, the image forming unit 14 includes toner image forming units 22 and a transfer device 117.

(Toner Image Forming Unit)

Figure 2:
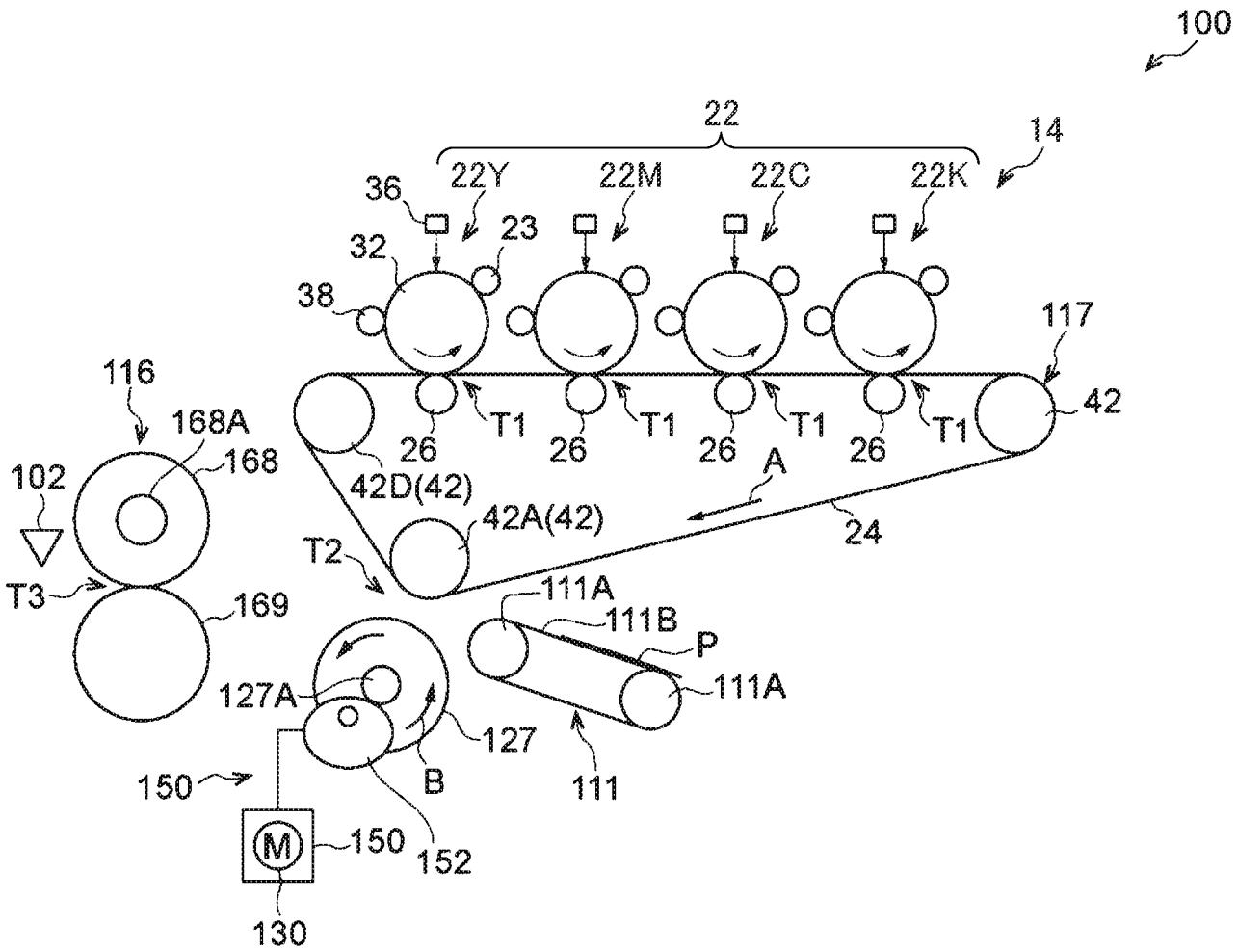
FIG. 2 is a schematic view showing a state in which a secondary transfer roller of the image forming apparatus according to the first exemplary embodiment in FIG. 1 is separated from an intermediate transfer belt.

The toner image forming unit 22 as an example of a colorant image former shown in FIGS. 1 and 2 has a function of forming a toner image. Plural toner image forming units 22 are provided to form a toner image for each color. In the present exemplary embodiment, the toner image forming units 22 are provided for four colors in total: the toner image forming unit 22Y for yellow, the toner image forming unit 22M for magenta, the toner image forming unit 22C for cyan, and the toner image forming unit 22K for black as shown in FIG. 1.

Since the toner image forming unit 22 of each color has the same configuration except for a toner to be used, on behalf of the toner image forming unit 22 of each color, each part of the toner image forming unit 22Y is denoted by a reference numeral in FIG. 1.

Specifically, the toner image forming unit 22 of each color includes a photoconductor drum 32 (photoconductor) that rotates in one direction (for example, in a counterclockwise direction in FIG. 1). Further, the toner image forming unit 22 of each color includes a charging unit 23, an exposure device 36, and a developing device 38.

In the toner image forming unit 22 of each color, the charging unit 23 charges the photoconductor drum 32. Further, the exposure device 36 exposes the photoconductor drum 32 charged by the charging unit 23 to form an electrostatic latent image on the photoconductor drum 32. The developing device 38 develops the electrostatic latent image formed on the photoconductor drum 32 by the exposure device 36 to form a toner image.

(Transfer Device)

The transfer device 117 shown in FIGS. 1 and 2 is a device that transfers the toner image formed by the toner image forming unit 22 to the recording medium P. The transfer device 117 includes an intermediate transfer belt 24, primary transfer rollers 26, a secondary transfer roller 127, a facing roller 42A, and a contact-and-separation mechanism 150 (hereinafter called a contact/separation mechanism 150). The transfer device 17 superimposes and primarily transfers the toner image of the photoconductor drum 32 of each color to the intermediate transfer belt 24 as an intermediate transfer body, and secondarily transfers the superimposed toner image to the recording medium P at a secondary transfer position T2.

(Primary Transfer Roller)

Each of the primary transfer rollers 26 shown in FIGS. 1 and 2 is a roller that transfers the toner image of the photoconductor drum 32 of each color to the intermediate transfer belt 24 at a primary transfer position T1 between the photoconductor drum 32 and the primary transfer roller 26. In the present exemplary embodiment, the toner image formed on the photoconductor drum 32 is transferred to the intermediate transfer belt 24 at the primary transfer position T1 by applying a primary transfer electric field between the primary transfer roller 26 and photoconductor drum 32.

(Intermediate Transfer Belt)

The toner image is transferred from the photoconductor drum 32 of each color to an outer circumferential surface of the intermediate transfer belt 24 as an example of an image holder shown in FIGS. 1 and 2. Specifically, the intermediate transfer belt 24 is configured as follows. As shown in FIG. 1, the intermediate transfer belt 24 has an annular shape. Further, the intermediate transfer belt 24 is wound around plural rollers 42 including a driving roller 42D and the facing roller 42A, and a posture of the intermediate transfer belt 24 is determined. The intermediate transfer belt 24 rotates in a predetermined direction indicated by an arrow A by, for example, rotationally driving the driving roller 42D among the plural rollers 42.

(Secondary Transfer Roller and Facing Roller)

The secondary transfer roller 127 as an example of a transfer member shown in FIGS. 1 and 2 has a function of transferring a toner image to the recording medium P. The secondary transfer roller 127 is rotationally driven in a direction indicated by an arrow B.

The secondary transfer roller 127 and the facing roller 42A are disposed to face each other with the intermediate transfer belt 24 interposed therebetween. In the present exemplary embodiment, the secondary transfer position T2 at which the toner image is to be transferred from the intermediate transfer belt 24 to the recording medium P is formed between the secondary transfer roller 127 and the facing roller 42A. When a secondary transfer electric field is applied between the secondary transfer roller 127 and the facing roller 42A, the toner image primarily transferred to the intermediate transfer belt 24 is secondarily transferred to the recording medium P at the secondary transfer position T2.

(Contact/Separation Mechanism)

The contact/separation mechanism 150 shown in FIGS. 1 and 2 has a function of moving the secondary transfer roller 127. Specifically, the contact/separation mechanism 150 moves the secondary transfer roller 127 between a contact state shown in FIG. 1 in which the secondary transfer roller 127 is in contact with the intermediate transfer belt 24 and a separated state shown in FIG. 2 in which the secondary transfer roller 127 is separated from the intermediate transfer belt 24. The contact/separation mechanism 150 is provided with a cam 152 and a contact-and-separation motor 130 (hereinafter called a contact/separation motor 130) for rotating the cam 152. The cam 152 is in contact with a shaft 127A of the secondary transfer roller 127, and the cam 152 rotates to move the secondary transfer roller 127. In the contact/separation mechanism 150, a rotation position of the cam 152 may be detected by an optical sensor (not shown). Accordingly, a contact state or a separation state of the secondary transfer roller 127 is monitored.

The contact/separation mechanism 150 is a mechanism that moves the secondary transfer roller 127 in a state of being rotationally driven. That is, even in the separated state shown in FIG. 2 in which the secondary transfer roller 127 is separated from the intermediate transfer belt 24, the secondary transfer roller 127 may be rotationally driven. An example is a mechanism in which a driving unit and the secondary transfer roller 127 are integrally moved. However, if the driving unit is configured to be able to rotate the secondary transfer roller 127 even in the separated state in which the secondary transfer roller 127 is separated from the intermediate transfer belt 24, the driving unit does not necessarily need to be moved together with the secondary transfer roller 127.

(Transport Device)

A transport device 111 shown in FIGS. 1 and 2 has a function of transporting the recording medium P transported from an upstream side to the secondary transfer position T2 described above. The transport device 111 includes an annular transport belt 111B wound around a pair of rolls 111A.

(Fixing Device)

The fixing device 116 as an example of a fixing unit shown in FIGS. 1 and 2 has a function of fixing a toner image transferred to the recording medium P. The fixing device 116 includes a heating roller 168 and a pressurizing roller 169. The heating roller 168 includes a heating source 168A such as a halogen lamp. The heating roller 168 forms a fixing region T3 in which the recording medium P is sandwiched between the heating roller 168 and the pressurizing roller 169, and heats a toner image in a state in which the recording medium P is sandwiched between the heating roller 168 and the pressurizing roller 169 at the fixing region T3, and fixes the toner image to the recording medium P.

(Sheet Sensor)

A sheet sensor 102 is provided on a downstream side of the recording medium P of the fixing device 116 in a transporting direction shown in FIGS. 1 and 2. The sheet sensor 102 detects the recording medium P discharged from the fixing device 116. In the present exemplary embodiment, the sheet sensor 102 uses an optical sensor capable of detecting a leading end portion and trailing end portion of the recording medium P.

(Drive Mechanism)

Figure 3:
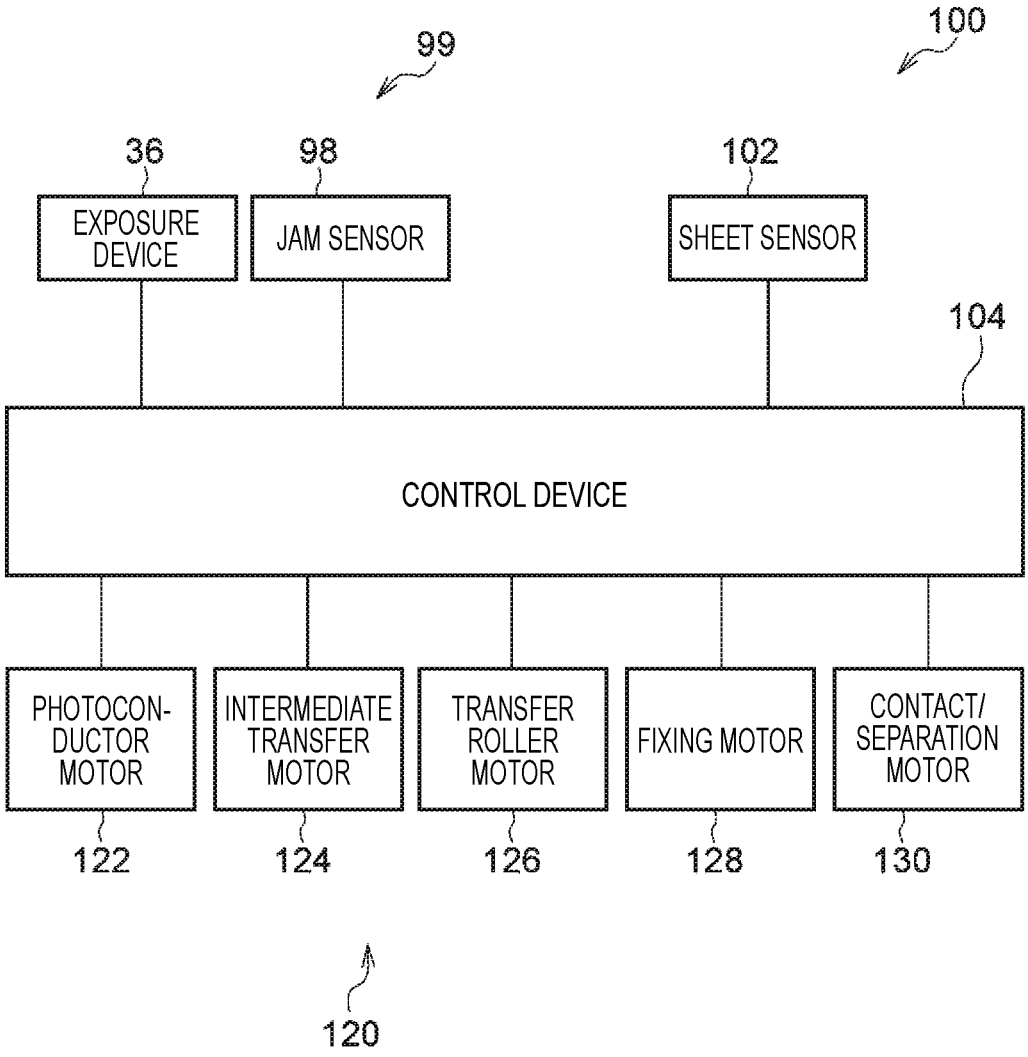
FIG. 3 is a block diagram of the image forming apparatus according to the first exemplary embodiment.

As shown in FIG. 3, the image forming apparatus 100 includes a drive mechanism 120. The drive mechanism 120 has a function of driving various members of the image forming apparatus 100. The drive mechanism 120 includes a photoconductor motor 122 that rotationally drives the photoconductor drum 32 of each color (see FIGS. 1 and 2), an intermediate transfer motor 124 that rotationally drives the driving roller 42D (see FIGS. 1 and 2) of the intermediate transfer belt 24 (see FIGS. 1 and 2), a transfer roller motor 126 that rotationally drives the secondary transfer roller 127 (see FIGS. 1 and 2), a fixing motor 128 that rotationally drives the pressurizing roller 169 (see FIGS. 1 and 2) of the fixing device 116 (see FIGS. 1 and 2), and the contact/separation motor 130 that drives the contact/separation mechanism 150 (see FIGS. 1 and 2).

(Abnormality Detection Device)

As shown in FIG. 3, the image forming apparatus 100 includes an abnormality detection device 99 that detects various abnormalities. The abnormality detection device 99 includes a jam sensor 98. The jam sensor 98 is provided at plural positions of a transporting path of the recording medium P (see FIGS. 1 and 2), and detects that the recording medium P (see FIGS. 1 and 2) is jammed or the like and is not appropriately transported, that is, a so-called jam occurs. The abnormality detection device 99 includes an abnormality detection sensor (not shown) in addition to the jam sensor 98. Abnormalities other than the jam are detected, for example, when a user opens a door of a body (not shown) in order to observe an inside of the image forming apparatus 100 even during printing, when a toner necessary for image formation is run out, when it is time to replace a component constituting the image forming apparatus, or when a positional deviation of the intermediate transfer belt 24 is detected. The abnormalities other than the jam are detected when an abnormality occurs in a torque of various motors, when an abnormality occurs in the contact or the separation by the optical sensor for monitoring the contact state or the separation state of the secondary transfer roller 127, or the like.

(Control Device)

A control device 104 shown in FIG. 3 has a function of controlling the entire image forming apparatus 100. A hardware configuration of the control device 104 includes a computer including a central processing unit (CPU) (not shown), a read only memory (ROM) that stores a program or the like for realizing each processing routine, a random access memory (RAM) that temporarily stores data, a memory as a storage means, a network interface, and the like.

The photoconductor motor 122, the intermediate transfer motor 124, the transfer roller motor 126, the fixing motor 128, and the contact/separation motor 130 constituting the drive mechanism 120 are electrically connected to the control device 104.

The exposure device 36 for each color, the jam sensor 98, and the sheet sensor 102 are electrically connected to the control device 104.

[Operation at the Time of Abnormality Detection]

Next, an operation of the image forming apparatus 100 when the abnormality detection device 99 detects an abnormality will be described.

Figure 4:
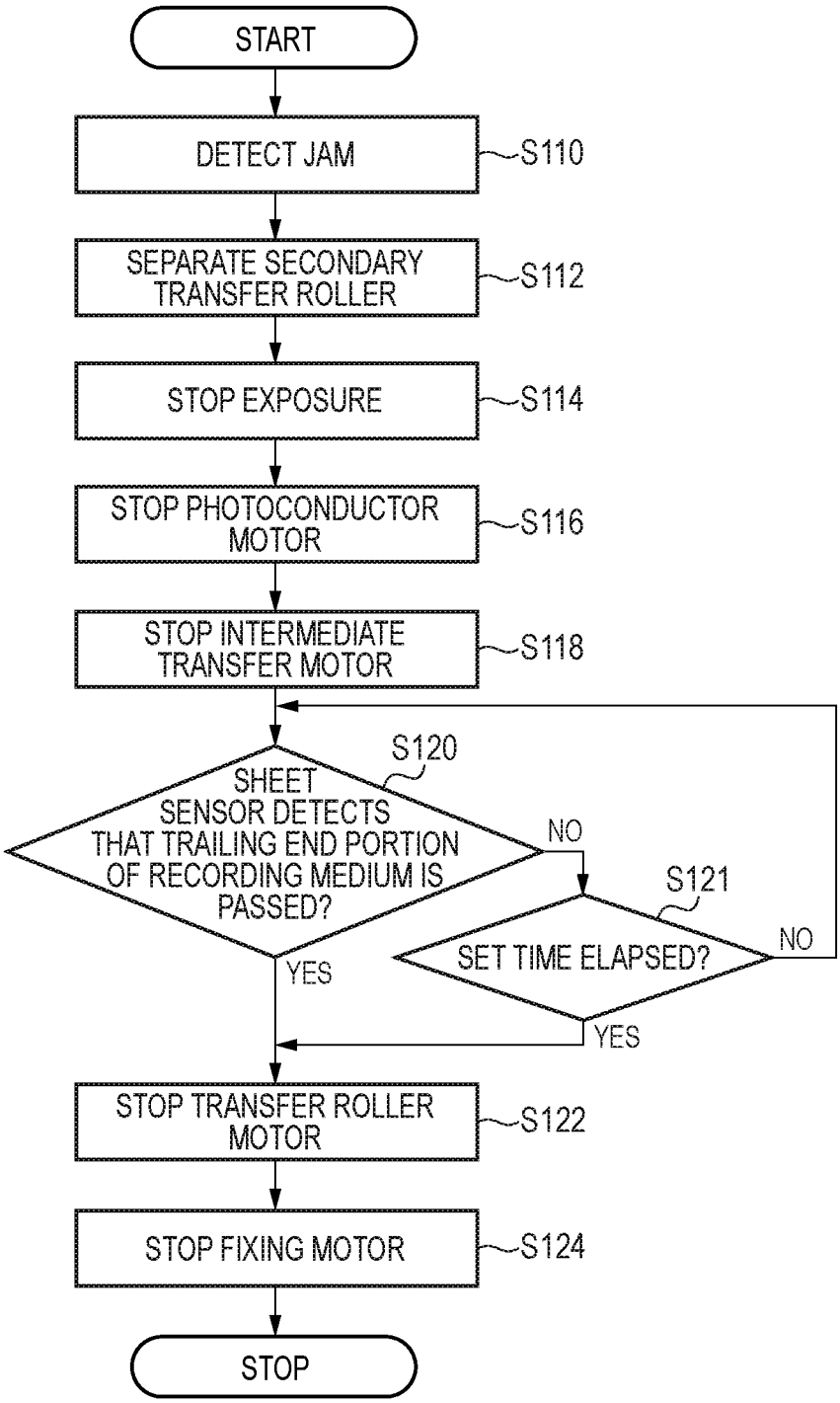
FIG. 4 is a flowchart of an operation at the time of abnormality detection of the image forming apparatus according to the first exemplary embodiment.

FIG. 4 is a flowchart showing an example of a flow of the operation of the image forming apparatus 100 at the time of abnormality detection executed by the CPU (not shown) of the control device 104. A program is stored in advance in, for example, the ROM (not shown) of the control device 104. The CPU (not shown) of the control device 104 reads the program stored in the ROM (not shown), and executes the operation of the image forming apparatus 100 at the time of abnormality detection.

In the present operation, when the abnormality detection device 99 detects an abnormality, the recording medium P is controlled not to be transported to the secondary transfer position T2 in a case where the recording medium P is present on an upstream side of the secondary transfer position T2.

In step S110, the abnormality detection device 99 detects an abnormality, and in the present example, the jam sensor 98 detects a jam of the recording medium P.

In step S112, the contact/separation motor 130 is driven to separate the secondary transfer roller 127 from the intermediate transfer belt 24.

In step S114, the exposure by the exposure device 36 is stopped. In step S116, the driving of the photoconductor motor 122 is stopped to stop the rotation of the photoconductor drum 32. In step S118, the driving of the intermediate transfer motor 124 is stopped to stop the rotation of the intermediate transfer belt 24. Step S114, step S116, and step S118 may be performed at the same time. In particular, step S116 and step S118 may be performed at the same time.

In step S120, it is determined whether the sheet sensor 102 provided on a downstream side of the fixing device 116 detects the trailing end portion of the recording medium P. When the trailing end portion of the recording medium P is not detected, the process proceeds to step S121. When the trailing end portion of the recording medium P is detected, the process proceeds to step S122.

Here, when the abnormality detection device 99 detects an abnormality, the present operation is performed for the recording medium P on a most upstream side in a case where plural recording media P are present between the secondary transfer position T2 and the fixing region T3.

In step S121, it is determined whether a predetermined set time is elapsed from the abnormality detection. When the set time is not elapsed, the process returns to step S120. When the set time is elapsed, the process proceeds to step S122.

In step S122, the driving of the transfer roller motor 126 is stopped, and the rotation of the secondary transfer roller 127 is stopped. Then, in step S124, the driving of the fixing motor 128 is stopped to stop the fixing device 116. Step S122 and step S124 may be performed at the same time. That is, the secondary transfer roller 127 and the fixing device 116 may be stopped at the same time.

From another point of view, a command for stopping the driving of the intermediate transfer motor 124 may be issued after a command for driving the contact/separation motor 130 is issued, and a command for stopping the driving of the transfer roller motor 126 may be issued after the command for stopping the driving of the intermediate transfer motor 124 is issued. Accordingly, the rotation of the intermediate transfer belt 24 is stopped after the secondary transfer roller 127 is separated from the intermediate transfer belt 24, and the rotation of the secondary transfer roller 127 is stopped after the rotation of the intermediate transfer belt 24 is stopped. Conversely, the command for stopping the driving of the transfer roller motor 126 is not issued before the command for stopping the driving of the intermediate transfer motor 124 is issued. Similarly, the command for stopping the driving of the intermediate transfer motor 124 is not issued until the command for driving the contact/separation motor 130 is issued.

When an abnormality is detected and the image forming apparatus 100 is to be stopped, the secondary transfer roller 127 is separated from the intermediate transfer belt 24, so that the rotational driving of the photoconductor drum 32 and the intermediate transfer belt 24 may be stopped at an early stage, and the rotational driving of the secondary transfer roller 127 may be continuously performed.

By stopping the rotational driving of the photoconductor drum 32 and the intermediate transfer belt 24 at an early stage, a load on the photoconductor drum 32 and the intermediate transfer belt 24 is reduced.

Even after the secondary transfer roller 127 is separated from the intermediate transfer belt 24, the driving of secondary transfer roller 127 and the fixing device 116 is continued, so that the recording medium P is transported to a downstream side of the secondary transfer position T2. Therefore, it is easy to remove the recording medium P. Further, after the sheet sensor 102 provided on the downstream side of the fixing device 116 detects the trailing end portion of the recording medium P, the fixing device 116 is stopped, that is, the fixing device 116 is stopped after the recording medium P is discharged from the fixing device 116. Therefore, the recording medium P to which the toner image is fixed may be removed.

As described above, the rotational driving of the photoconductor drum 32 and the intermediate transfer belt 24 may be stopped at an early stage as compared with a case where the secondary transfer roller 127 and the intermediate transfer belt 24 are in contact with each other until the rotational driving of the secondary transfer roller 127 is stopped, and thus the load on the photoconductor drum 32 and the intermediate transfer belt 24 is reduced.

The recording medium P to which the toner image is fixed may be removed as compared with a case where the rotational driving of the fixing device 116 is stopped before the trailing end portion of the recording medium P passes through the fixing device 116, and thus the recording medium P may be easily removed.

[Modification]

Next, a modification of the image forming apparatus according to the first exemplary embodiment will be described. Only parts different from those in the above exemplary embodiment will be described.

(Drive Mechanism)

Figure 5:
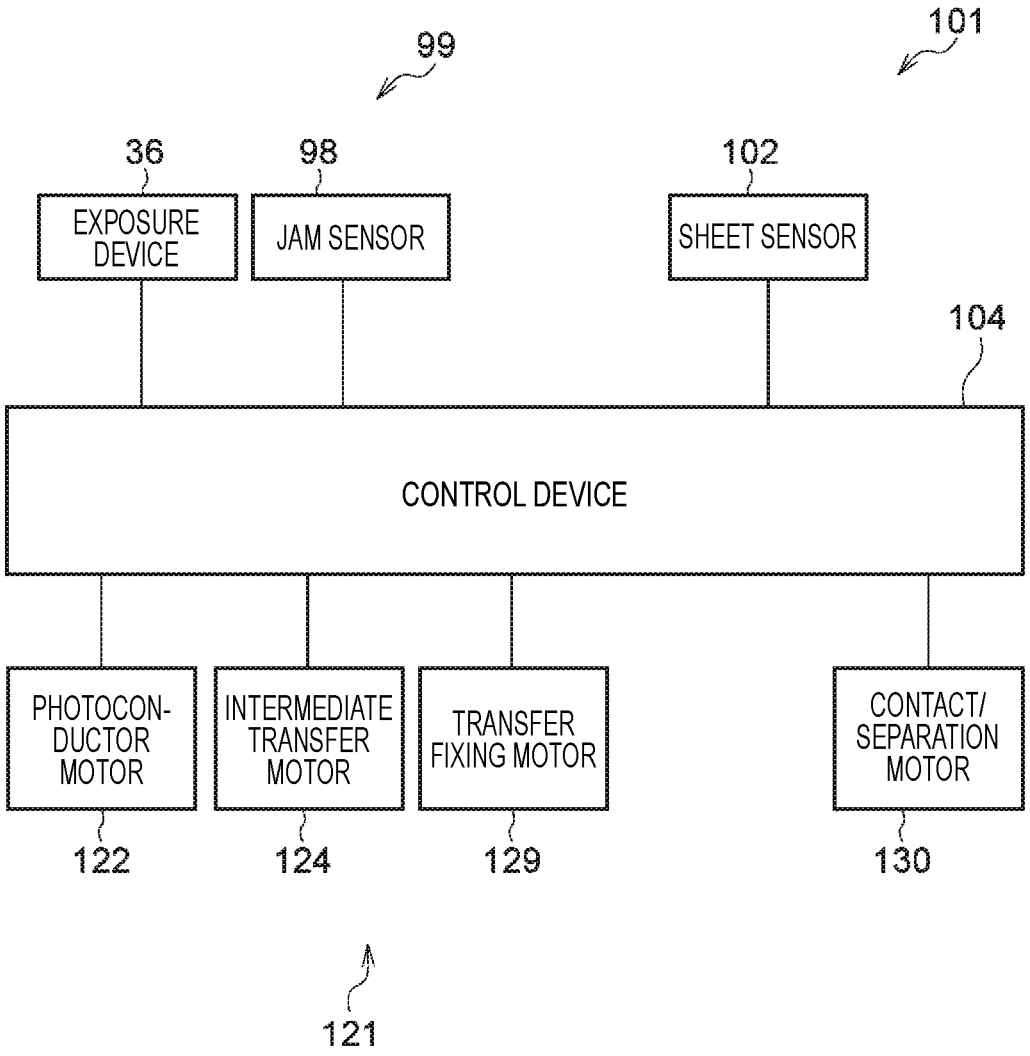
FIG. 5 is a block diagram of an image forming apparatus according to a modification of the first exemplary embodiment.

As shown in FIG. 5, in an image forming apparatus 101 according to the modification, the secondary transfer roller 127 and the fixing device 116 (see FIGS. 1 and 2) are rotationally driven by a single transfer fixing motor 129. Accordingly, the rotational driving of the secondary transfer roller 127 and the fixing device 116 is stopped in interlocking with each other, that is, the rotational driving of the secondary transfer roller 127 and the fixing device 116 is stopped at the same time.

Also in the present modification, the contact/separation mechanism 150 is a mechanism that moves the secondary transfer roller 127 in a state of being rotationally driven. That is, even in the separated state in which the secondary transfer roller 127 is separated from the intermediate transfer belt 24, the secondary transfer roller 127 and the fixing device 116 may be rotationally driven.

A drive mechanism 121 of the image forming apparatus 101 according to the modification includes the photoconductor motor 122, the intermediate transfer motor 124, the transfer fixing motor 129, and the contact/separation motor 130.

(Control Device)

The control device 104 shown in FIG. 5 has a function of controlling the entire image forming apparatus 101. The photoconductor motor 122, the intermediate transfer motor 124, the transfer fixing motor 129, and the contact/separation motor 130 are electrically connected to the control device 104.

[Operation at the Time of Abnormality Detection]

Next, an operation of the image forming apparatus 101 according to the modification when the abnormality detection device 99 detects an abnormality will be described.

Figure 6:
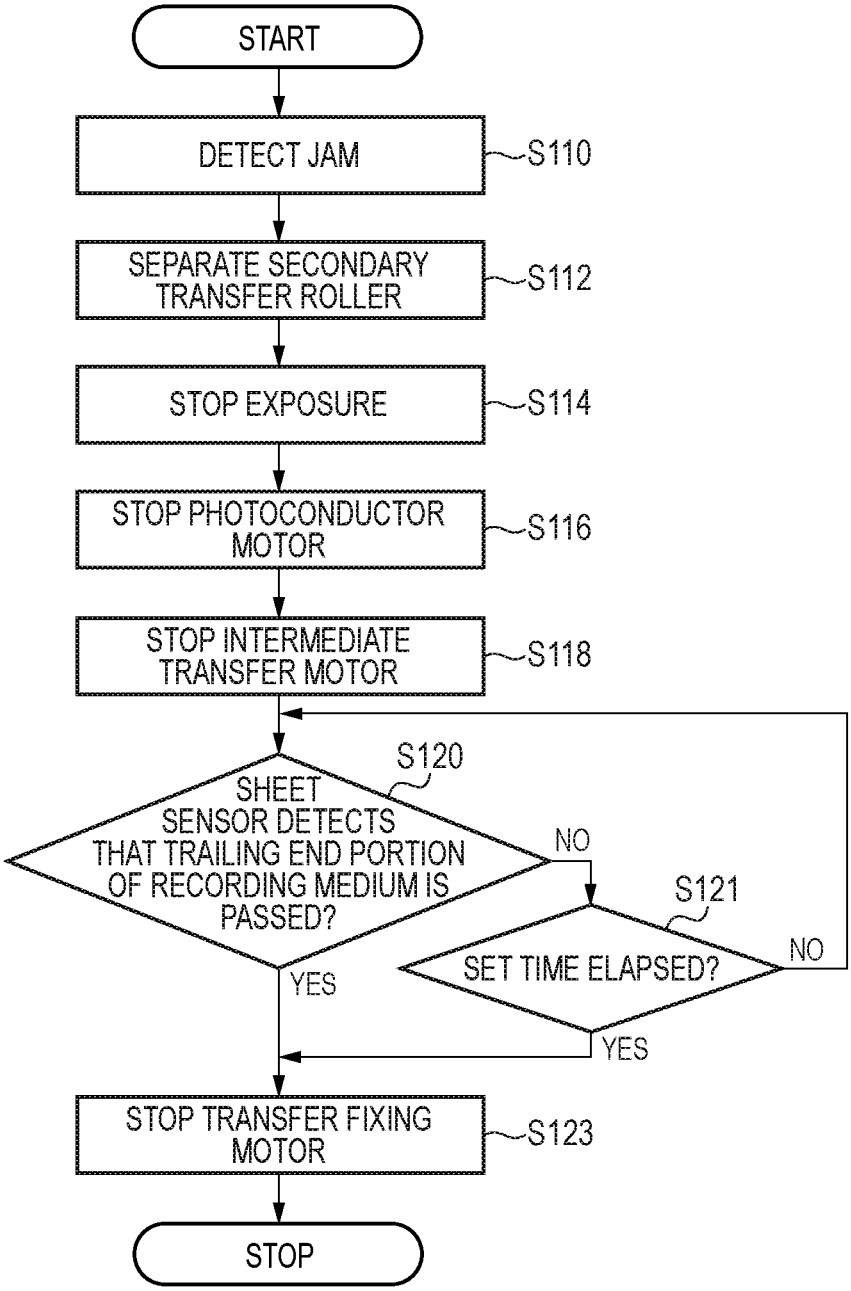
FIG. 6 is a flowchart of an operation at the time of abnormality detection of the image forming apparatus according to the modification of the first exemplary embodiment.

FIG. 6 is a flowchart showing an example of a flow of the operation of the image forming apparatus 101 at the time of abnormality detection executed by the CPU (not shown) of the control device 104.

Steps S110 to S118 are the same as those in the above exemplary embodiment, and thus the description thereof will be omitted.

In step S120, it is determined whether the sheet sensor 102 provided on the downstream side of the fixing device 116 detects the trailing end portion of the recording medium P. When the trailing end portion of the recording medium P is not detected, the process proceeds to step S121. When the trailing end portion of the recording medium P is detected, the process proceeds to step S123.

When the abnormality detection device 99 detects an abnormality, the present operation is performed for the recording medium P on a most upstream side in a case where plural recording media P are present between the secondary transfer position T2 and the fixing region T3.

In step S121, it is determined whether a set time is elapsed from the abnormality detection. When the set time is not elapsed, the process returns to step S120. When the set time is elapsed, the process proceeds to step S123.

In step S123, the driving of the transfer fixing motor 129 is stopped to stop the secondary transfer roller 127 and the fixing device 116.

From another point of view, a command for stopping the driving of the transfer fixing motor 129 may be issued after a command for stopping the driving of the intermediate transfer motor 124 is issued. Accordingly, the rotation of the secondary transfer roller 127 and the fixing device 116 is stopped after the rotation of the intermediate transfer belt 24 is stopped. Conversely, the command for stopping the driving of the transfer fixing motor 129 is not issued before the command for stopping the driving of the intermediate transfer motor 124 is issued.

The rotational driving of the photoconductor drum 32 and the intermediate transfer belt 24 may be stopped at an early stage as compared with a case where the secondary transfer roller 127 and the intermediate transfer belt 24 are in contact with each other until the rotational driving of the secondary transfer roller 127 is stopped, and thus a load on the photoconductor drum 32 and the intermediate transfer belt 24 is reduced.

The recording medium P to which the toner image is fixed may be removed as compared with a case where the rotational driving of the secondary transfer roller 127 is stopped after the rotational driving of the fixing device 116 is stopped.

The recording medium P to which the toner image is fixed may be removed as compared with a case where the rotational driving of the secondary transfer roller 127 and the fixing device 116 is stopped before the trailing end portion of the recording medium P passes through the fixing device 116.

Second Exemplary Embodiment

Next, an example of an image forming apparatus according to a second exemplary embodiment of the present invention will be described. The same members as those in the first exemplary embodiment are denoted by the same reference numerals, and the redundant description thereof will be omitted or simplified.

[Apparatus Configuration]

First, an apparatus configuration of the image forming apparatus will be described.

(Overall Configuration of Image Forming Apparatus)

Figure 7:
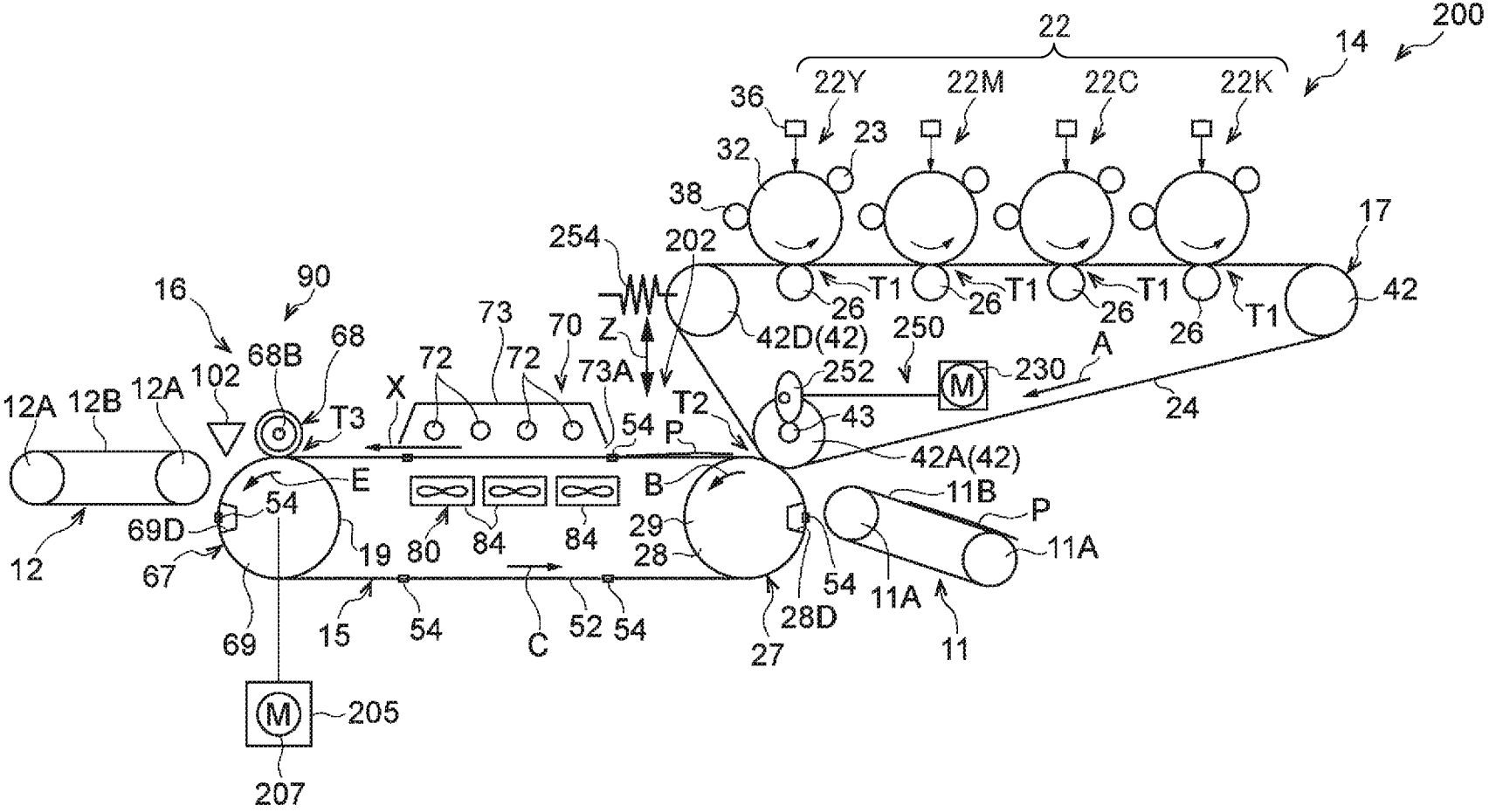
FIG. 7 is a schematic view of an image forming apparatus according to a second exemplary embodiment.
Figure 8:
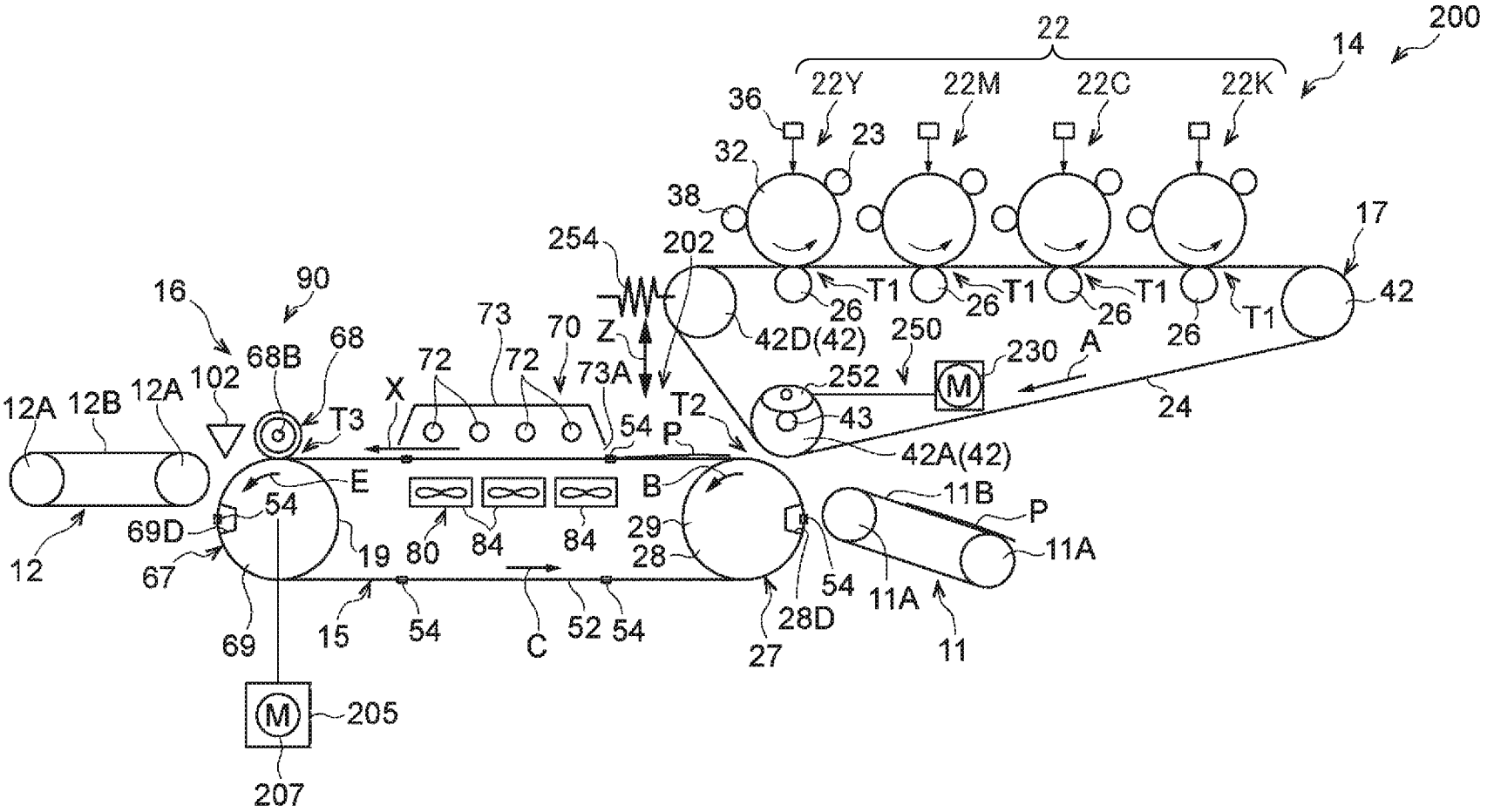
FIG. 8 is a schematic view showing a state in which a transfer cylinder of the image forming apparatus according to the second exemplary embodiment in FIG. 7 is separated from an intermediate transfer belt.

The image forming apparatus 200 shown in FIGS. 7 and 8 is an electrophotographic image forming apparatus that forms a toner image as an example of a colorant image on the recording medium P such as a sheet. More specifically, the image forming apparatus 200 includes the image forming unit 14, the first transport body 11, a second transport body 12, and a fixing device 16. Hereinafter, a configuration of each unit of the image forming apparatus 200 will be described.

(Image Forming Unit)

The image forming unit 14 is an example of a forming unit that forms an image on a recording medium, and includes the toner image forming units 22 and a transfer device 17.

(Toner Image Forming Unit)

The toner image forming unit 22 as an example of a colorant image forming device has the same configuration as that in the first exemplary embodiment, and thus the description thereof will be omitted.

(Transfer Device)

The transfer device 17 shown in FIGS. 7 and 8 primarily transfers a toner image of each color of the photoconductor drum 32 of each color to the intermediate transfer belt 24 as the intermediate transfer body, and secondarily transfers the superimposed toner image to the recording medium P at the secondary transfer position T2. The transfer device 17 includes the intermediate transfer belt 24, the primary transfer rollers 26, a secondary transfer body 27, the facing roller 42A, and a contact-and-separation mechanism 250 (hereinafter called a contact/separation mechanism 250).

(Primary Transfer Roller)

The primary transfer roller 26 has the same configuration as that in the first exemplary embodiment, and thus the description thereof will be omitted.

(Intermediate Transfer Belt)

The intermediate transfer belt 24 as the example of the image holder has the same configuration as that in the first exemplary embodiment, and thus the description thereof will be omitted. However, the driving roller 42D is provided with a tensioner spring 254.

(Secondary Transfer Body and Facing Roller)

Figure 9:
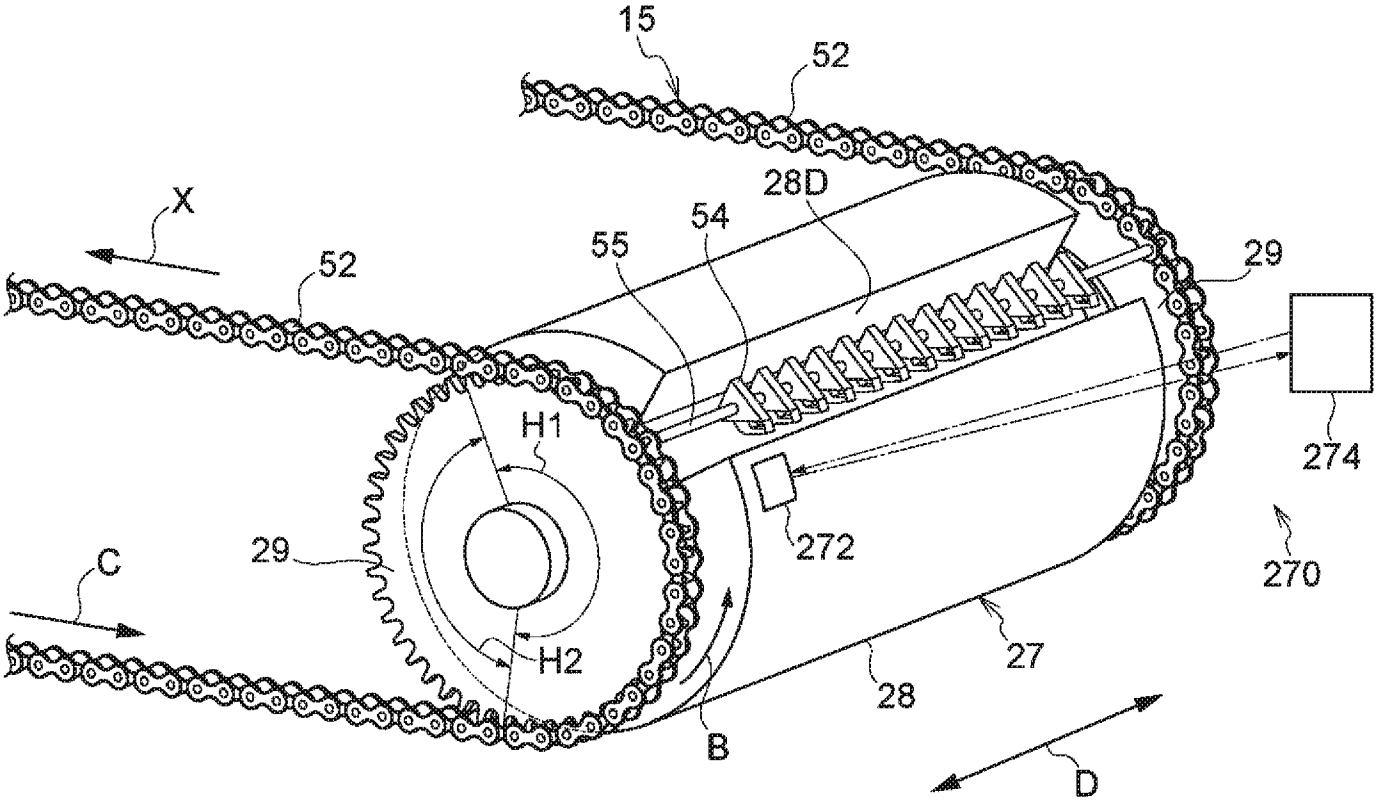
FIG. 9 is a perspective view showing a secondary transfer body and a part of a transport unit of the image forming apparatus according to the second exemplary embodiment.

The secondary transfer body 27 shown in FIGS. 7 and 8 has a function of transferring a toner image to the recording medium P. As shown in FIG. 9, the secondary transfer body 27 includes a transfer cylinder 28 and a pair of sprockets 29. The secondary transfer body 27 is rotationally driven in the direction indicated by the arrow B.

As shown in FIGS. 7 and 8, the transfer cylinder 28 and the facing roller 42A are disposed to face each other with the intermediate transfer belt 24 interposed therebetween. In the present exemplary embodiment, the secondary transfer position T2 at which the toner image is to be transferred from the intermediate transfer belt 24 to the recording medium P is formed between the transfer cylinder 28 and the facing roller 42A. When a secondary transfer electric field is applied between the transfer cylinder 28 and the facing roller 42A, the toner image primarily transferred to the intermediate transfer belt 24 is secondarily transferred to the recording medium P at the secondary transfer position T2.

As shown in FIG. 9, each recess 28D, in which grippers 54 and an attachment member 55 of a transport unit 15 to be described later are accommodated, is formed on an outer circumference of the transfer cylinder 28.

The pair of sprockets 29 are disposed on both axial end sides of the transfer cylinder 28, and a pair of chains 52 to be described later are wound around the sprockets 29, respectively. The pair of sprockets 29 are disposed coaxially with the transfer cylinder 28 and rotate integrally with the transfer cylinder 28.

(First Transport Body and Second Transport Body)

The first transport body 11 shown in FIGS. 7 and 8 is a transport body that transports the recording medium P to the transport unit 15 to be described later. Specifically, the first transport body 11 has a function of transporting the recording medium P and transferring the recording medium P to the grippers 54 of the transport unit 15 to be described later. More specifically, the first transport body 11 includes an annular transport belt 11B wound around a pair of rollers 11A.

The second transport body 12 is a transporting body that transports the recording medium P transported from the transport unit 15 to be described later. Specifically, the second transport body 12 has a function of receiving the recording medium P that is released from holding by the grippers 54 of the transport unit 15 to be described later, and transporting the recording medium P. More specifically, the second transport body 12 includes an annular transport belt 12B wound around a pair of rollers 12A.

(Fixing Device)

The fixing device 16 shown in FIGS. 7 and 8 has a function of heating the recording medium P to which the toner image is transferred, and fixing the toner image to the recording medium P. The fixing device 16 is also an example of a transport device that transports the recording medium P.

Specifically, the fixing device 16 is a device that fixes the toner image, which is transferred to the recording medium P by the transfer cylinder 28, to the recording medium P. More specifically, the fixing device 16 includes a fixing unit 90, a non-contact heating unit 70, an air blowing unit 80, and the transport unit 15.

(Fixing Unit)

The fixing unit 90 includes a heating roller 68 and a pressurizing body 67.

Figure 10:
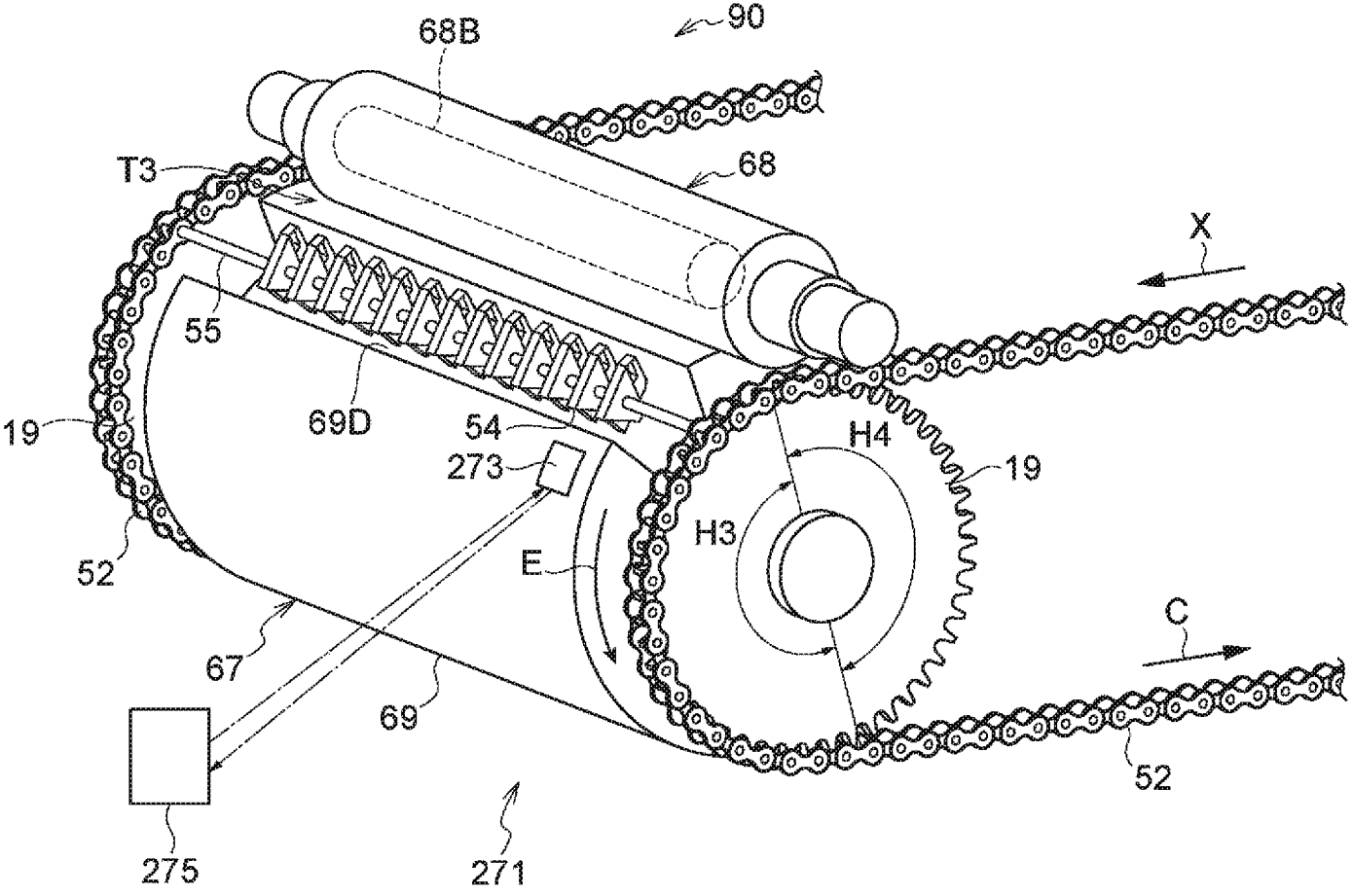
FIG. 10 is a perspective view showing a fixing unit and a part of the transport unit of the image forming apparatus according to the second exemplary embodiment.

As shown in FIG. 10, the pressurizing body 67 includes a fixing cylinder 69 and a pair of sprockets 19. The pressurizing body 67 is rotationally driven in a direction indicated by an arrow E.

The fixing cylinder 69 functioning as a pressurizing roller has a function of pressurizing the recording medium P with the recording medium P (see FIGS. 7 and 8) sandwiched between the fixing cylinder 69 and the heating roller 68. Further, each recess 69D, in which the grippers 54 and the attachment member 55 as an example of a holding unit of the transport unit 15 are accommodated, is formed on an outer circumference of the fixing cylinder 69.

As shown in FIG. 10, the pair of sprockets 19 are disposed on both axial end sides of the fixing cylinder 69, and the pair of chains 52 to be described later are wound around the sprockets 19, respectively. The pair of sprockets 19 are disposed coaxially with the fixing cylinder 69, and rotate integrally with the fixing cylinder 69.

The heating roller 68 has a function of fixing an image formed on the recording medium P with the recording medium P sandwiched between the heating roller 68 and the fixing cylinder 69. Specifically, the heating roller 68 includes a heating source 68B such as a halogen lamp therein. The heating roller 68 has the fixing region T3 in which the recording medium P is sandwiched between the heating roller 68 and the fixing cylinder 69. The heating roller 68 heats and pressurizes the toner image in a state in which the recording medium P is sandwiched between the heating roller 68 and the fixing cylinder 69 in the fixing region T3, and fixes the toner image to the recording medium P.

(Transport Unit)

The transport unit 15 shown in FIGS. 7 and 8 has a function of transporting the recording medium P in a transport direction X (the direction indicated by the arrow A). Specifically, the transport unit 15 has a function of transporting the recording medium P from the secondary transfer position T2 to the fixing region T3 between the heating roller 68 and the fixing cylinder 69. The transport direction X is a leftward direction in FIG. 1. Specifically, the transport direction X is a horizontal direction. Therefore, the transport unit 15 is a transport mechanism that transports the recording medium P in the horizontal direction.

More specifically, as shown in FIGS. 9 and 10, the transport unit 15 includes the pair of chains 52 and the grippers 54. The gripper 54 is the example of the holding unit that holds the recording medium P. The pair of chains 52 are an example of a rotation member to which the holding unit is attached and which transports the recording medium P by rotating itself. In FIGS. 7 and 8, the chains 52 and the grippers 54 are shown in a simplified manner.

As shown in FIGS. 7 and 8, the pair of chains 52 are formed in an annular shape. As shown in FIGS. 9 and 10, the pair of chains 52 are disposed at an interval in an apparatus depth direction D. Each of the pair of chains 52 is wound around the pair of sprockets 29 (see FIG. 9) of the secondary transfer body 27 and the pair of sprockets 19 (see FIG. 10) of the pressurizing body 67. By rotating the secondary transfer body 27 including the pair of sprockets 29 and the pressurizing body 67 including the pair of sprockets 19, the chains 52 rotate in a rotation direction C (see FIGS. 7, 8, and 9). Accordingly, the transfer cylinder 28 of the secondary transfer body 27 and the fixing cylinder 69 of the pressurizing body 67 are rotationally driven in interlocking with each other, and the rotational driving thereof is stopped in interlocking with each other.

As shown in FIGS. 9 and 10, the attachment member 55 to which the grippers 54 are attached is extended along the apparatus depth direction D across the pair of chains 52.

Plural attachment members 55 are fixed to the pair of chains 52 at predetermined intervals along the rotation direction C of the chains 52.

Plural grippers 54 are attached to the attachment member 55 at predetermined intervals along the apparatus depth direction D. In other words, the grippers 54 are attached to the chains 52 via the attachment member 55. The gripper 54 has a function of holding a leading end portion of the recording medium P.

Figure 11:
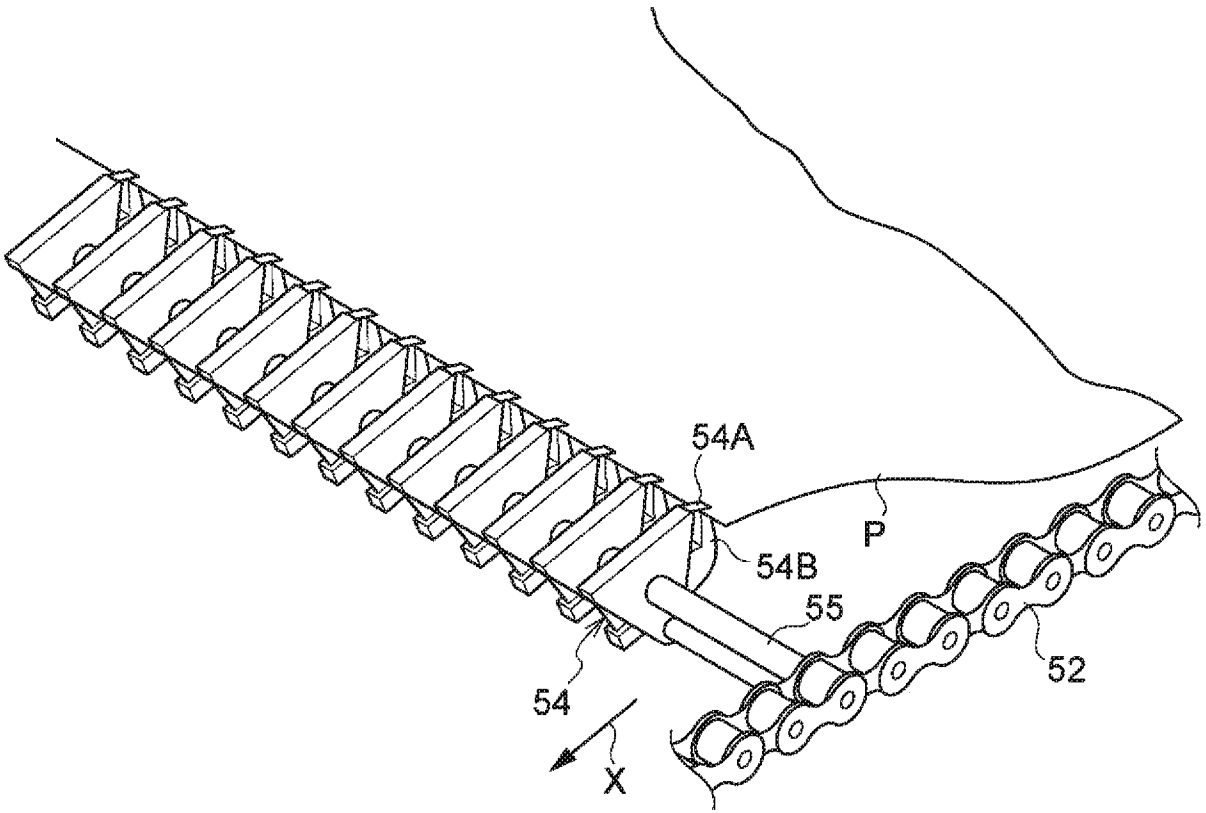
FIG. 11 is a perspective view showing a part of the transport unit of the image forming apparatus according to the second exemplary embodiment.

As shown in FIG. 11, the gripper 54 includes a claw 54A and a claw base 54B. The claw 54A and the claw base 54B are disposed on an upstream side of the gripper 54 in the transport direction. That is, the claw 54A and the claw base 54B constitute a portion of the gripper 54 on the upstream side in the transport direction. The claw 54A and the claw base 54B are an example of a holding portion that holds the recording medium P.

The gripper 54 is configured to hold the recording medium P by sandwiching the leading end portion of the recording medium P between the claw 54A and the claw base 54B. In other words, the gripper 54 may be a gripping unit that grips the recording medium P in a thickness direction. The leading end portion of the recording medium P is a downstream end portion of the recording medium P in the transport direction X.

More specifically, the gripper 54 holds the leading end portion of the recording medium P outside an image region of the recording medium P. The image region of the recording medium P is a region to which the toner image is transferred in the recording medium P. In the gripper 54, for example, the claw 54A is pressed against the claw base 54B by a spring or the like, and the claw 54A is opened and closed with respect to the claw base 54B by an action of a cam or the like.

Further, a width of each of the grippers 54 along the apparatus depth direction D is narrower than a width of the recording medium P. Therefore, the gripper 54 holds a part of the recording medium P in the apparatus depth direction D.

In the transport unit 15, the leading end portion of the recording medium P sent from the first transport body 11 is held by the gripper 54 as shown in FIG. 11.

As shown in FIGS. 7 and 8, in the transport unit 15, the chains 52 rotate in the rotation direction C in a state in which the gripper 54 holds the leading end portion of the recording medium P, so that the gripper 54 is moved to transport the recording medium P. The recording medium P passes through the secondary transfer position T2 together with the gripper 54 while being held by the gripper 54. At a portion where the chain 52 is wound around the sprocket 29, the gripper 54 moves integrally with the transfer cylinder 28 in the rotation direction B of the transfer cylinder 28 in a state where the gripper 54 is accommodated in the recess 28D of the transfer cylinder 28.

After the recording medium P is caused to pass through the secondary transfer position T2, the recording medium P is further caused to pass through the fixing region T3 together with the gripper 54 while the recording medium P is held by the gripper 54. At a portion where the chain 52 is wound around the sprocket 19, the gripper 54 moves integrally with the fixing cylinder 69 in the rotation direction E of the fixing cylinder 69 in a state where the gripper 54 is accommodated in the recess 69D of the fixing cylinder 69. When the recording medium P passes through the fixing region T3, the holding of the recording medium P by the gripper 54 is released.

(Non-Contact Heating Unit)

The non-contact heating unit 70 shown in FIGS. 7 and 8 has a function of heating the recording medium P transported by the transport unit 15 in a non-contact manner. The non-contact heating unit 70 preheats an unfixed toner image formed on a surface of the recording medium P in the non-contact manner. Specifically, the non-contact heating unit 70 includes heaters 72, a reflection plate 73, and a shielding mechanism 202.

The heater 72 is a heating member that heats the recording medium P in a non-contact manner with respect to the recording medium P transported in the transport direction X by the transport unit 15.

Plural heaters 72 are arranged at intervals along the transport direction X. The heater 72 includes a cylindrical infrared heater having a length in the apparatus depth direction D. The heater 72 generates heat by a filament (not shown) provided therein, and heats the recording medium P by the radiant heat of the filament. In the present exemplary embodiment, four heaters 72 are provided, but the number of heaters 72 is not limited to four The reflection plate 73 has a function of reflecting infrared rays from the heater 72 to a lower side of the device, that is, a side of the recording medium P transported by the transport unit 15. Specifically, the reflection plate 73 has a box shape in which an opening 73A is formed at the lower side of the device. The reflection plate 73 is formed using a metal plate such as an aluminum plate.

(Air Blowing Unit)

The air blowing unit 80 shown in FIGS. 7 and 8 is disposed on a side opposite to the non-contact heating unit 70 with respect to the recording medium P, that is, on a lower side of the non-contact heating unit 70, and faces the non-contact heating unit 70 in a vertical direction Z.

Specifically, the air blowing unit 80 has a function of blowing air to a lower surface of the recording medium P transported by the transport unit 15. More specifically, the air blowing unit 80 has a function of floating the recording medium P by blowing air to the recording medium P to maintain a non-contact state with respect to the recording medium P, such that the recording medium P is transported by the transport unit 15 in a state where the air blowing unit 80 is in the non-contact state with respect to a back surface opposite to the surface of the recording medium P on which an unfixed image is formed.

The air blowing unit 80 includes plural air blowers 84 arranged along the transport direction X. The plural air blowers 84 send air upward, and blow the air against the lower surface of the recording medium P to float the recording medium P. As an example, an axial air blower that blows air in an axial direction is used as the air blower 84. As the air blower 84, a centrifugal air blower that blows air in a centrifugal direction such as a multi-blade air blower may be used.

(Transfer Fixing Drive Mechanism)

A transfer fixing drive mechanism 205 shown in FIGS. 7 and 8 is a mechanism that rotationally drives the transfer cylinder 28 of the secondary transfer body 27 and the fixing cylinder 69 of the fixing unit 90 in interlocking with each other.

(Shielding Mechanism)

Figure 12:
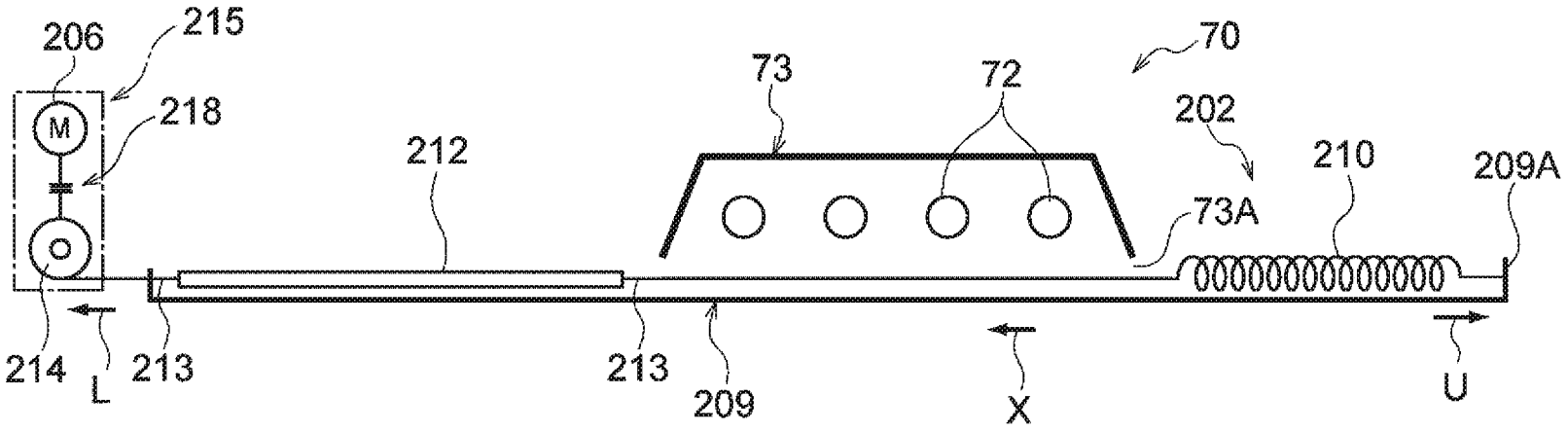
FIG. 12 is a schematic view of a non-contact heating unit in an open state of a shielding member.
Figure 13:
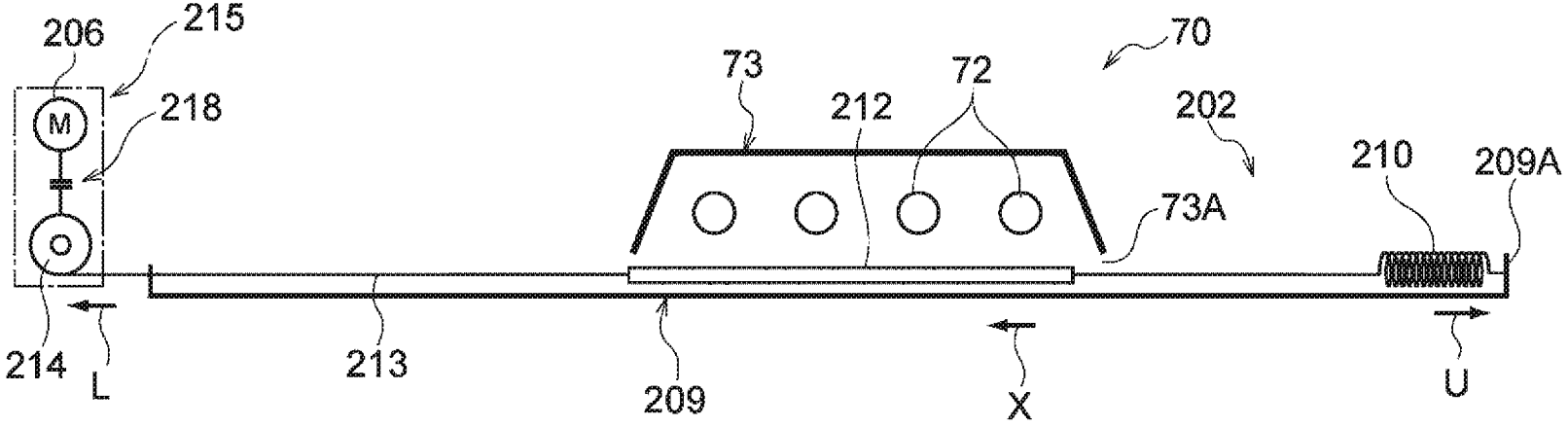
FIG. 13 is a schematic view of the non-contact heating unit in a closed state of the shielding member.

As shown in FIGS. 12 and 13, the shielding mechanism 202 shown in FIGS. 7 and 8 includes a plate-shaped shielding member 212 having a size that covers and shields the opening 73A of the reflection plate 73 of the non-contact heating unit 70. The shielding member 212 constitutes a single shielding portion. Both side portions of the shielding member 212 are movably supported by a rail 209 extending along the transport direction of the recording medium P.

As shown in FIG. 12, when the shielding member 212 moves to an upstream side U in a medium transport direction along the rail 209, the shielding member 212 is in an open state in which the opening 73A of the reflection plate 73 of the non-contact heating unit 70 is opened. Accordingly, heat is allowed to be released downward from the non-contact heating unit 70.

As shown in FIG. 13, when the shielding member 212 moves to a downstream side L in the medium transport direction along the rail 209, the shielding member 212 is in a closed state in which the opening 73A of the reflection plate 73 of the non-contact heating unit 70 is closed. Accordingly, the heat released downward from the non-contact heating unit 70 is shielded.

One end of a coil spring 210 is fixed to an end surface 209A of the rail 209 on the upstream side U in the medium transport direction, and the other end of the coil spring 210 is attached to an end portion of the shielding member 212 on the upstream side U in the medium transport direction. Accordingly, the shielding member 212 is pulled toward the upstream side U in the medium transport direction by the coil spring 210. Therefore, a force is constantly applied to the shielding member 212 so as to be in the closed state in which the non-contact heating unit 70 is closed.

(Opening/Closing Mechanism)

As shown in FIGS. 12 and 13, an opening-and-closing mechanism 215 (hereinafter called opening/closing mechanism 215) is provided on the downstream side L of the non-contact heating unit 70 in the medium transport direction. The opening/closing mechanism 215 includes a winding-up roller 214 that winds up a wire 213 extending from the downstream side L of the shielding member 212 in the medium transport direction so as to be able to be drawn out, and an opening-and-closing motor 206 (hereinafter called an opening/closing motor 206) that rotates the winding-up roller 214 in a winding-up direction. Further, the opening/closing mechanism 215 includes an electromagnetic clutch 218 that connects and disconnects the opening/closing motor 206 and a rotation mechanism of the winding-up roller 214.

The opening/closing motor 216 receives power and rotates the winding-up roller 214 in the winding-up direction, so as to drive the shielding member 212 to the downstream side L in the medium transport direction to form the open state in which the non-contact heating unit 70 is opened. The opening/closing motor 206 prevents unexpected rotation of the winding-up roller 214 by an idle torque of the opening/closing motor 206.

While the electromagnetic clutch 218 receives power and is turned on, the electromagnetic clutch 218 connects the opening/closing motor 206 to the rotation mechanism of the winding-up roller 214, and the rotation of the winding-up roller 214 is regulated by the idle torque of the opening/closing motor 206.

When the power is cut off and the electromagnetic clutch 218 is turned off, the electromagnetic clutch 218 releases the connection between the opening/closing motor 206 and the rotation mechanism of the winding-up roller 214. Therefore, when the power supply is cut off due to a power failure or the like and the electromagnetic clutch 218 is turned off, the winding-up roller 214 is rotatable, and the shielding member 82 moves to the upstream side U in the medium transport direction by the coil spring 210 to form the closed state in which the non-contact heating unit 70 is closed.

(Contact/Separation Mechanism)

The contact/separation mechanism 250 shown in FIGS. 7 and 8 has a function of moving the facing roller 42A. Specifically, the contact/separation mechanism 250 moves the facing roller 42A between a contact state in which the intermediate transfer belt 24 wound around the facing roller 42A shown in FIG. 7 is in contact with the transfer cylinder 28 and a separated state in which the intermediate transfer belt 24 is separated from the transfer cylinder 28 shown in FIG. 8. The contact/separation mechanism 250 is provided with a cam 252 and a contact-and-separation motor 230 (hereinafter called a contact/separation motor 230) for rotating the cam 252. The cam 252 is in contact with a shaft 43 of the secondary transfer roller 127, and the cam 252 rotates to move the facing roller 42A. The contact/separation mechanism 250 is provided with an optical sensor (not shown) so as to detect a rotation position of the cam 252. Accordingly, a contact state or a separation state of the facing roller 42A is monitored.

As the facing roller 42A moves, the tensioner spring 254 expands or contracts. Accordingly, when the facing roller 42A is separated, a tension of the intermediate transfer belt 24 is prevented from decreasing. When the facing roller 42A is separated, the intermediate transfer belt 24 is separated from the transfer cylinder 28 by the tension of the tensioner spring 254.

(Sheet Sensor)

The sheet sensor 102 is provided on the downstream side of the recording medium P of the fixing device 16 in the transport direction and on the upstream side of the second transport body 12 in the transport direction shown in FIGS. 7 and 8. The sheet sensor 102 detects the recording medium P discharged from the fixing device 16.

(Transfer Cylinder Position Detection Mechanism)

A transfer cylinder position detection mechanism 270 shown in FIG. 9 is a mechanism that detects a rotation position of the transfer cylinder 28. In the present exemplary embodiment, the transfer cylinder position detection mechanism 270 includes a patch 272 and a transfer cylinder optical sensor 274. The patch 272 is attached to an axial end portion of the transfer cylinder 28. The rotation position of the transfer cylinder 28 is detected by reading a position of the patch 272 by the transfer cylinder optical sensor 274.

In the present exemplary embodiment, the transfer cylinder position detection mechanism 270 detects a state in which the gripper 54 is located in a range H1 where the chain 52 is wound around the transfer cylinder 28.

A range H2 is a range in which the gripper 54 is located in a range where the chain 52 is not wound around the transfer cylinder 28, and the gripper 54 is located between the upper and lower chains 52.

(Fixing Cylinder Position Detection Mechanism)

A fixing cylinder position detection mechanism 271 shown in FIG. 10 is a mechanism that detects a rotation position of the fixing cylinder 69. In the present exemplary embodiment, the fixing cylinder position detection mechanism 271 includes a patch 273 and a fixing cylinder optical sensor 275. The patch 273 is attached to an axial end portion of the fixing cylinder 69. The rotation position of the fixing cylinder 69 is detected by reading a position of the patch 273 by the fixing cylinder optical sensor 275.

In the present exemplary embodiment, the fixing cylinder position detection mechanism 271 detects a state in which the gripper 54 is located in a range H3 excluding the fixing region T3 of the fixing unit 90 in a range in which the chain 52 is wound around the fixing cylinder 69.

A range H4 is a range including a region where the chain 52 is not wound around the fixing cylinder 69 and the fixing region T3. That is, the range H4 is a region including a range in which the gripper 54 is located between the upper and lower chains 52 and the fixing region T3.

(Drive Mechanism)

Figure 14:
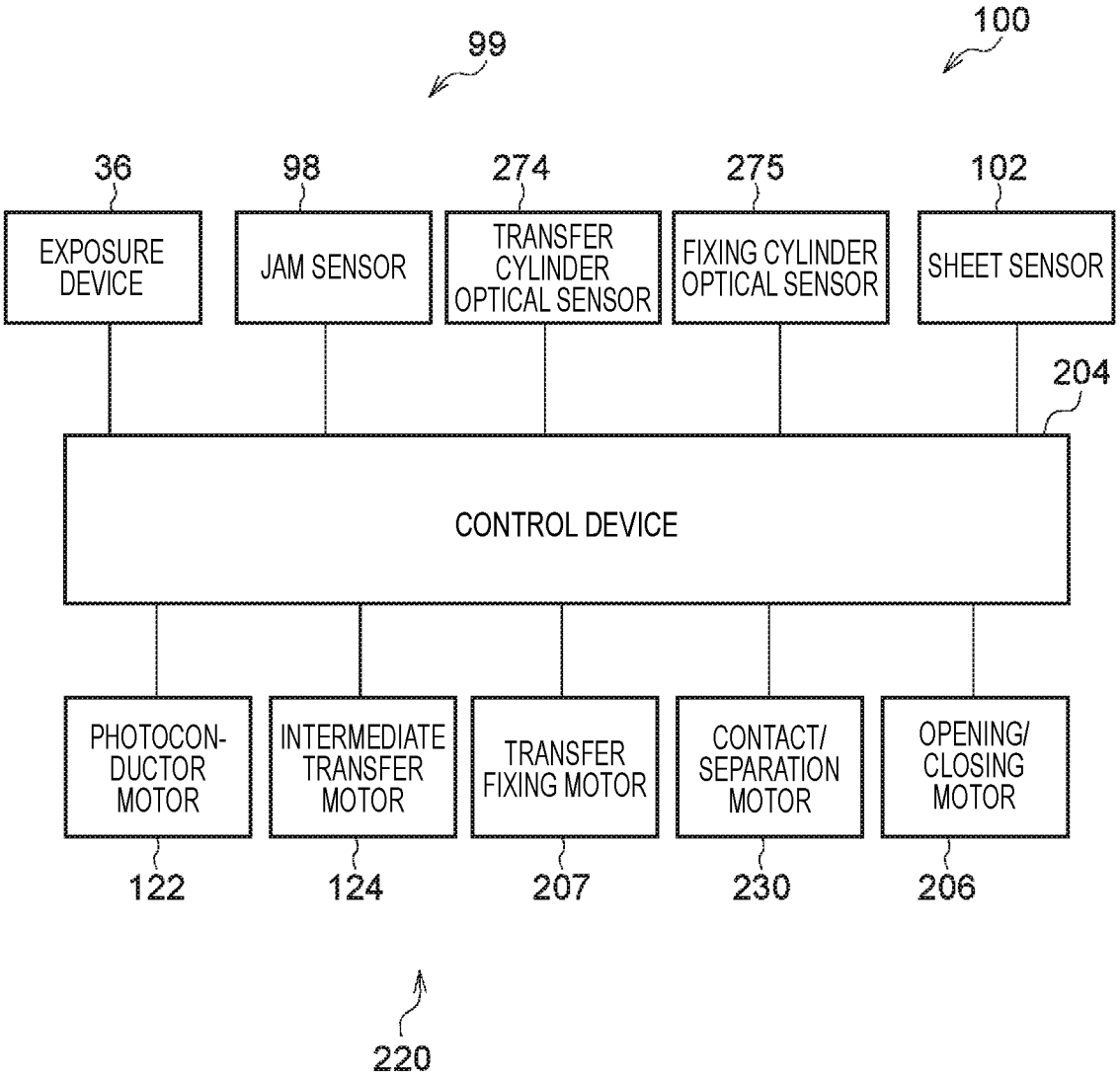
FIG. 14 is a block diagram of the image forming apparatus according to the second exemplary embodiment.

As shown in FIG. 14, the image forming apparatus 200 includes a drive mechanism 220. The drive mechanism 220 has a function of driving various members of the image forming apparatus 200. The drive mechanism 220 includes the photoconductor motor 122, the intermediate transfer motor 124, a transfer fixing motor 207 that rotationally drives the transfer fixing drive mechanism 205 (see FIGS. 7 and 8), the contact-and-separation motor 230 that drives the contact-and-separation mechanism 250 (see FIGS. 7 and 8), and the opening-and-closing motor 206 of the opening-and-closing mechanism 215 (see FIGS. 12 and 13).

(Abnormality Detection Device)

The abnormality detection device 99 shown in FIG. 14 is the same as that in the first exemplary embodiment, and thus the description thereof will be omitted.

(Control Device)

A control device 204 shown in FIG. 14 has a function of controlling the entire image forming apparatus 200. A hardware configuration of the control device 204 includes a computer including a central processing unit (CPU) (not shown), a read only memory (ROM) that stores a program or the like for realizing each processing routine, a random access memory (RAM) that temporarily stores data, a memory as a storage means, a network interface, and the like.

The photoconductor motor 122, the intermediate transfer motor 124, the transfer fixing motor 207, the contact/separation motor 230, and the opening/closing motor 206 constituting the drive mechanism 220 are electrically connected to the control device 204.

The exposure device 36 for each color, the jam sensor 98, the sheet sensor 102, the transfer cylinder optical sensor 274, and the fixing cylinder optical sensor 275 are electrically connected to the control device 204.

[Operation at the Time of Abnormality Detection]

Next, an operation of the image forming apparatus 200 when the abnormality detection device 99 detects an abnormality will be described.

Figure 15:
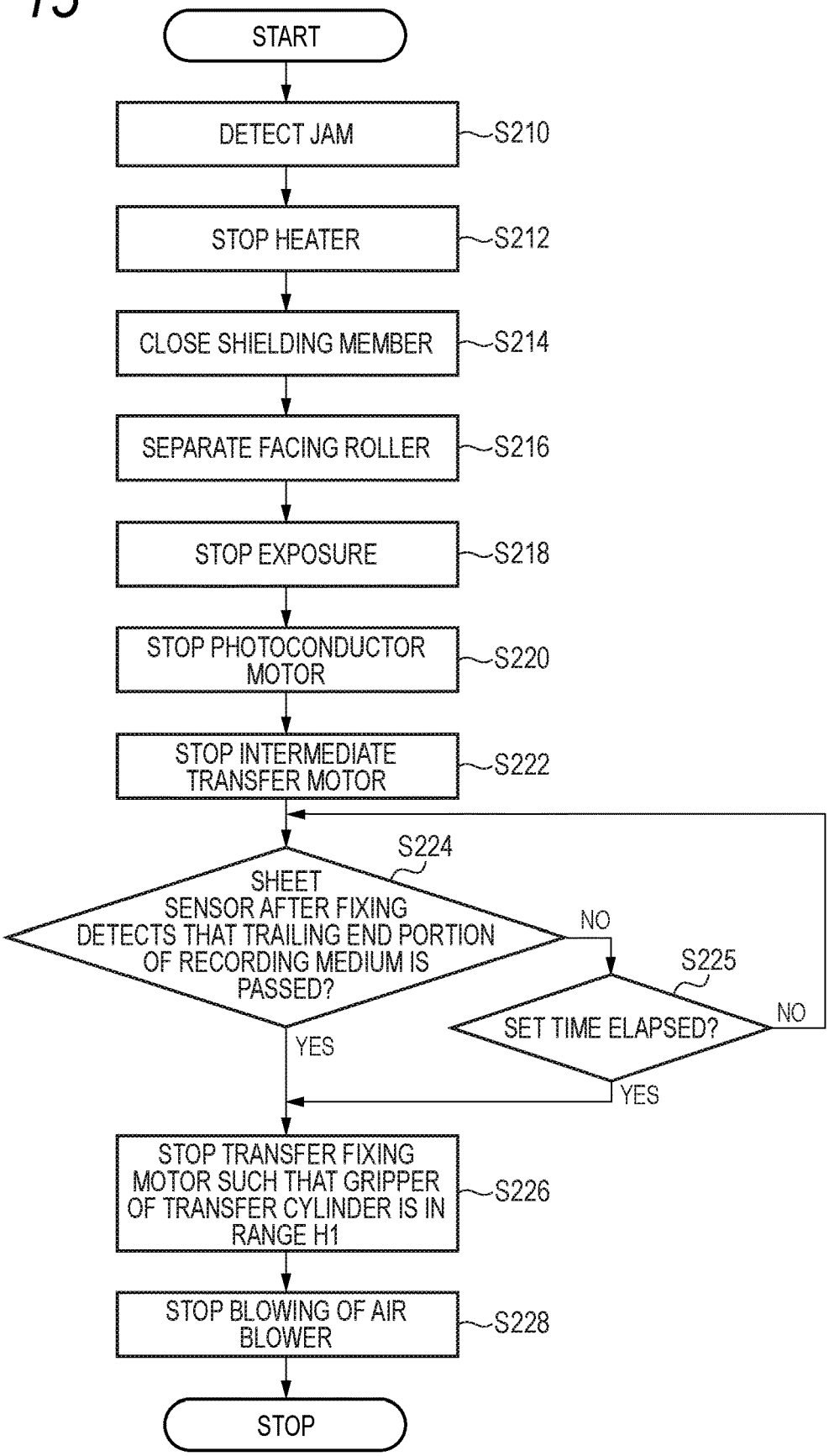
FIG. 15 is a flowchart of an operation at the time of abnormality detection of the image forming apparatus according to the second exemplary embodiment.

FIG. 15 is a flowchart showing an example of a flow of the operation of the image forming apparatus 200 at the time of abnormality detection executed by the CPU (not shown) of the control device 204. A program is stored in advance in, for example, the ROM (not shown) of the control device 204. The CPU (not shown) of the control device 204 reads the program stored in the ROM (not shown), and executes the operation of the image forming apparatus 200 at the time of abnormality detection.

In the present operation, when the abnormality detection device 99 detects an abnormality, the recording medium P is controlled not to be transported to the secondary transfer position T2 in a case where the recording medium P is present on an upstream side of the secondary transfer position T2.

In step S210, the abnormality detection device 99 detects an abnormality. In the present exemplary embodiment, the jam sensor 98 detects a jam of the recording medium P.

In step S212, the heating of the heater 72 of the non-contact heating unit 70 is stopped. In step S214, the opening/closing motor 206 of the opening/closing mechanism 215 is driven to move and close the shielding member 212. Step S212 and step S214 may be performed at the same time.

In step S216, the contact/separation motor 230 is driven to separate the facing roller 42A from the intermediate transfer belt 24. Accordingly, the intermediate transfer belt 24 is separated from the transfer cylinder 28 by the tension of the tensioner spring 254.

In step S218, the exposure by the exposure device 36 is stopped. In step S220, the driving of the photoconductor motor 122 is stopped to stop the rotation of the photoconductor drum 32. In step S222, the driving of the intermediate transfer motor 124 is stopped to stop the rotation of the intermediate transfer belt 24. Step S218, step S220, and step S222 may be performed at the same time. In particular, step S220 and step S222 may be performed at the same time.

In step S224, it is determined whether the sheet sensor 102 provided on a downstream side of the fixing device 16 detects the trailing end portion of the recording medium P. When the trailing end portion of the recording medium P is not detected, the process proceeds to step S225. When the trailing end portion of the recording medium P is detected, the process proceeds to step S226.

When the abnormality detection device 99 detects an abnormality, the present operation is performed for the recording medium P on a most upstream side in a case where plural recording media P are present between the secondary transfer position T2 and the fixing region T3.

In step S225, it is determined whether a set time is elapsed from the abnormality detection. When the set time is not elapsed, the process returns to step S224. When the set time is elapsed, the process proceeds to step S226.

In step S226, the driving of the transfer fixing motor 207 is stopped such that the gripper 54 of the transfer cylinder 28 is located in the range H1. In step S228, the air blowers 84 of the air blowing unit 80 are stopped. Step S226 and step S228 may be performed at the same time.

From another point of view, a command for stopping the driving of the intermediate transfer motor 124 may be issued after a command for driving the contact/separation motor 230 is issued, and a command for stopping the driving of the transfer fixing motor 207 may be issued after the command for stopping the driving of the intermediate transfer motor 124 is issued. Accordingly, the rotation of the intermediate transfer belt 24 is stopped after the transfer cylinder 28 is separated from the intermediate transfer belt 24, and the rotation of the transfer cylinder 28 and the fixing cylinder 69 is stopped after the rotation of the intermediate transfer belt 24 is stopped. Conversely, the command for stopping the driving of the transfer fixing motor 207 is not issued until the command for stopping the driving of the intermediate transfer motor 124 is issued. Similarly, the command for stopping the driving of the intermediate transfer motor 124 is not issued until the command for driving the contact/separation motor 230 is issued.

When an abnormality is detected and the image forming apparatus 200 is to be stopped, the transfer cylinder 28 is separated from the intermediate transfer belt 24, so that the rotational driving of the photoconductor drum 32 and the intermediate transfer belt 24 may be stopped at an early stage, and the rotational driving of the transfer cylinder 28 and the fixing cylinder 69 may be continuously performed.

By stopping the rotational driving of the photoconductor drum 32 and the intermediate transfer belt 24 at an early stage, a load on the photoconductor drum 32 and the intermediate transfer belt 24 is reduced.

Even after the transfer cylinder 28 is separated from the intermediate transfer belt 24, the rotational driving of the transfer cylinder 28 and the fixing cylinder 69 is continued, so that the recording medium P is transported to a downstream side of the secondary transfer position T2. Therefore, it is easy to remove the recording medium P. Further, after the sheet sensor 102 provided on a downstream side of the fixing unit 90 detects the trailing end portion of the recording medium P, that is, after the recording medium P is discharged from the fixing unit 90, the transfer cylinder 28 and the fixing cylinder 69 are stopped. Therefore, the recording medium P to which the toner image is fixed may be removed.

As described above, the rotational driving of the photoconductor drum 32 and the intermediate transfer belt 24 may be stopped at an early stage as compared with a case where the transfer cylinder 28 and the intermediate transfer belt 24 are in contact with each other until the rotational driving of the transfer cylinder 28 and the fixing cylinder 69 is stopped. Accordingly, the load on the photoconductor drum 32 and the intermediate transfer belt 24 is reduced.

The recording medium P to which the toner image is fixed may be removed as compared with a case where the rotational driving of the transfer cylinder 28 and the fixing cylinder 69 is stopped before the trailing end portion of the recording medium P passes through the fixing unit 90.

The trailing end portion of the recording medium P passes through the fixing unit 90, and the leading end portion of the recording medium P is not held by the gripper 54. Therefore, it is easy to remove the recording medium P as compared with a case where the rotational driving of the transfer cylinder 28 and the fixing cylinder 69 is stopped in a state where the leading end portion of the recording medium P is held by the gripper 54.

The rotational driving of the transfer cylinder 28 and the fixing cylinder 69 may be stopped in a state where the holding of the leading end portion of the recording medium P by the gripper 54 is released without directly detecting that the holding of the leading end portion of the recording medium P by the gripper 54 is released.

The transfer cylinder 28 is stopped such that the gripper 54 is located in the range H1. Therefore, the access to the gripper 54 of the transfer cylinder 28 is better as compared with a case where the transfer cylinder 28 is stopped such that the gripper 54 is located in the range H2 between the upper and lower chains 52.

The rotational driving of the transfer cylinder 28 and the fixing cylinder 69 is stopped after the trailing end portion of the recording medium P passes through the fixing unit 90, that is, after the recording medium P passes through the heating region where the recording medium P faces the non-contact heating unit 70. Therefore, the heat received by the recording medium P from the non-contact heating unit 70 may be reduced as compared with a case where the rotational driving is stopped before the recording medium P passes through the heating region facing the non-contact heating unit 70.

The blowing of the air blowers 84 of the air blowing unit 80 is stopped after the trailing end portion of the recording medium P passes through the fixing unit 90, that is, after the recording medium P passes through the heating region where the recording medium P faces the non-contact heating unit 70. Therefore, the heating of the recording medium P by the non-contact heating unit 70 may be prevented as compared with a case where the blowing of the air blowers 84 of the air blowing unit 80 is stopped before the trailing end portion of the recording medium P passes through the heating region.

[First Modification]

Next, a first modification of the image forming apparatus according to the second exemplary embodiment will be described. Only parts different from those in the above exemplary embodiment will be described. In the present modification, only an operation at the time of abnormality detection is different, and the configuration of the image forming apparatus 200 is the same.

[Operation at the Time of Abnormality Detection]

An operation of the image forming apparatus 200 according to the present modification when the abnormality detection device 99 detects an abnormality will be described.

Figure 16:
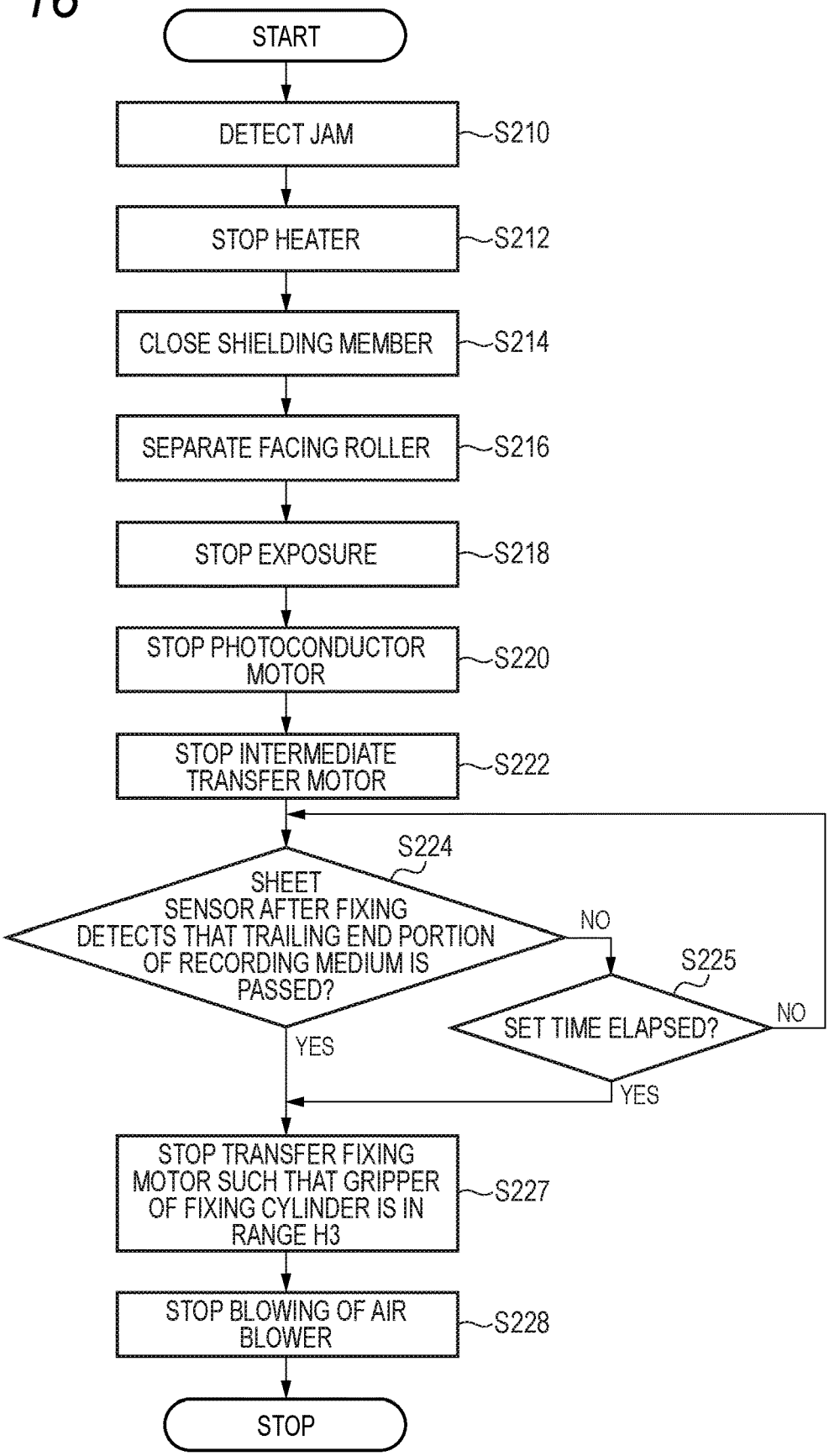
FIG. 16 is a flowchart of an operation at the time of abnormality detection of an image forming apparatus according to a first modification of the second exemplary embodiment.

FIG. 16 is a flowchart showing an example of a flow of the operation of the image forming apparatus 200 at the time of abnormality detection executed by the CPU (not shown) of the control device 204.

Steps S210 to S225 are the same as those in the above exemplary embodiment, and thus the description thereof will be omitted.

In step S227, the driving of the transfer fixing motor 207 is stopped such that the gripper 54 of the fixing cylinder 69 is located in the range H3. Then, in step S228, the air blowers 84 of the air blowing unit 80 are stopped. Step S227 and step S228 may be performed at the same time.

The fixing cylinder 69 is stopped such that the gripper 54 is located in the range H3. Therefore, the access to the gripper 54 of the fixing cylinder 69 is better as compared with a case where the fixing cylinder 69 is stopped such that the gripper 54 is located in the range H4 between the upper and lower chains 52 or the range of the fixing region T3.

[Second Modification]

Next, a second modification of the image forming apparatus according to the second exemplary embodiment will be described. Only parts different from those in the above exemplary embodiment will be described. In the present modification, only an operation at the time of abnormality detection is different, and the configuration of the image forming apparatus 200 is the same.

[Operation at the Time of Abnormality Detection]

An operation of the image forming apparatus 200 according to the modification when the abnormality detection device 99 detects an abnormality will be described.

Figure 17:
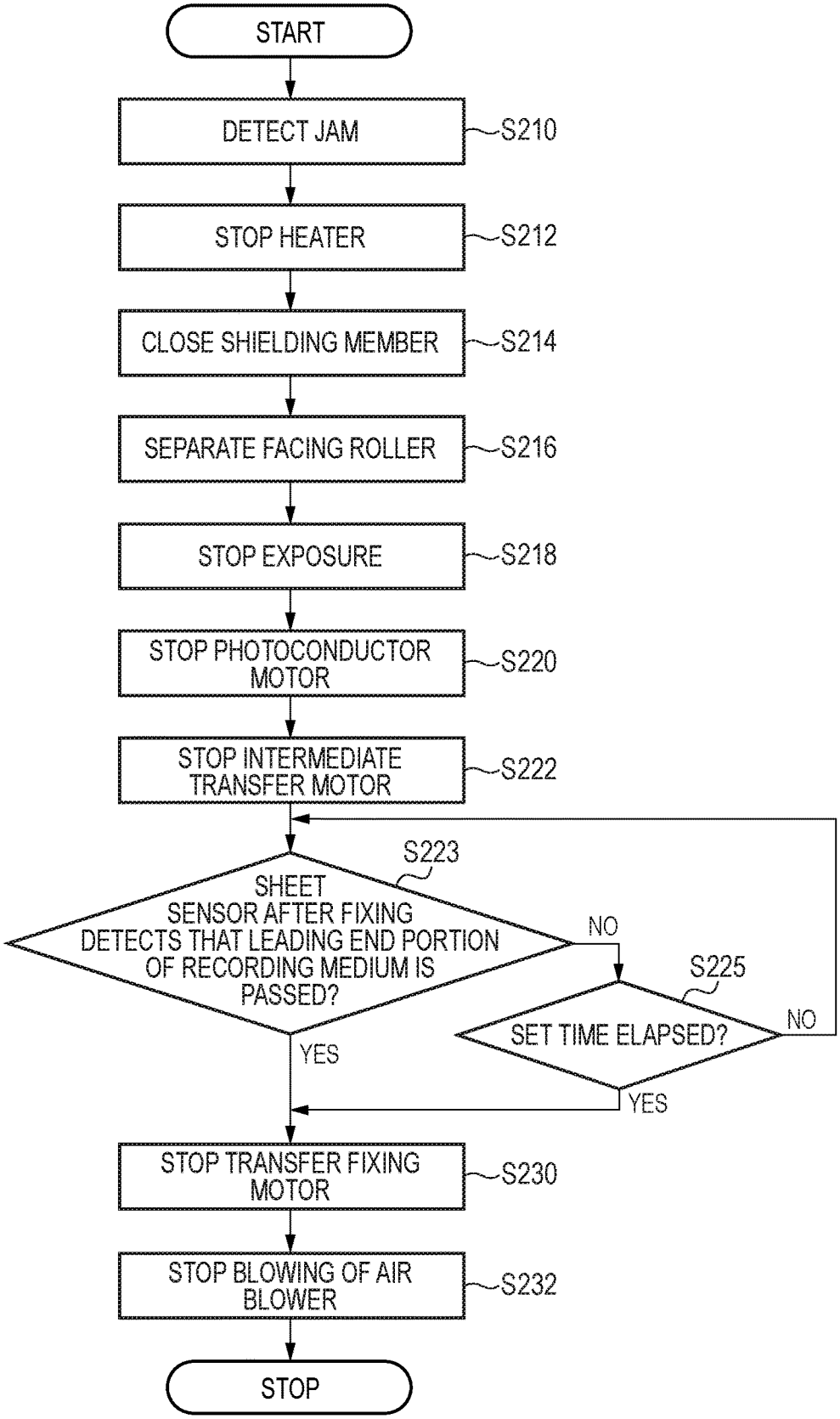
FIG. 17 is a flowchart of an operation at the time of abnormality detection of an image forming apparatus according to a second modification of the second exemplary embodiment.

FIG. 17 is a flowchart showing an example of a flow of the operation of the image forming apparatus 200 at the time of abnormality detection executed by the CPU (not shown) of the control device 204.

Steps S210 to S222 are the same as those in the above exemplary embodiment, and thus the description thereof will be omitted.

In step S223, it is determined whether the sheet sensor 102 provided on the downstream side of the fixing device 16 detects the leading end portion of the recording medium P. When the leading end portion of the recording medium P is not detected, the process proceeds to step S225. When the leading end portion of the recording medium P is detected, the process proceeds to step S230.

When the abnormality detection device 99 detects an abnormality, the present operation is performed for the recording medium P on a most upstream side in a case where plural recording media P are present between the secondary transfer position T2 and the fixing region T3.

In step S225, it is determined whether a set time is elapsed from the abnormality detection. When the set time is not elapsed, the process returns to step S223. When the set time is elapsed, the process proceeds to step S230.

In step S230, the driving of the transfer fixing motor 207 is stopped. Then, in step S232, the air blowers 84 of the air blowing unit 80 are stopped. Step S230 and step S232 may be performed at the same time.

The rotational driving of the photoconductor drum 32 and the intermediate transfer belt 24 may be stopped at an early stage as compared with the case where the transfer cylinder 28 and the intermediate transfer belt 24 are in contact with each other until the rotational driving of the transfer cylinder 28 and the fixing cylinder 69 is stopped, and thus a load on the photoconductor drum 32 and the intermediate transfer belt 24 is reduced.

As for the recording medium P, the leading end portion of the recording medium P passes through the fixing unit 90, and the leading end portion of the recording medium P is not held by the gripper 54. Therefore, it is easy to remove the recording medium P as compared the case where the rotational driving of the transfer cylinder 28 and the fixing cylinder 69 is stopped in a state where the leading end portion of the recording medium P is held by the gripper 54.

The rotational driving of the transfer cylinder 28 and the fixing cylinder 69 may be stopped in the state where the holding of the leading end portion of the recording medium P by the gripper 54 is released without directly detecting that the holding of the leading end portion of the recording medium P by the gripper 54 is released.

The rotational driving of the transfer cylinder 28 and the fixing cylinder 69 is stopped after the leading end portion of the recording medium P passes through the fixing unit 90, that is, after the recording medium P passes through the heating region facing the non-contact heating unit 70. Therefore, the heat received by the recording medium P from the non-contact heating unit 70 may be reduced as compared with a case of the rotational driving is stopped before the recording medium P passes through the heating region facing the non-contact heating unit 70.

The blowing of the air blowers 84 of the air blowing unit 80 is stopped after the leading end portion of the recording medium P passes through the fixing unit 90, that is, after the recording medium P passes through the heating region facing the non-contact heating unit 70. Therefore, the heating of the recording medium P by the non-contact heating unit 70 may be prevented as compared with a case where the blowing of the air blowers 84 of the air blowing unit 80 is stopped before the trailing end portion of the recording medium P passes through the heating region.

[Third Modification]

Next, a third modification of the image forming apparatus according to the second exemplary embodiment will be described. Only parts different from those in the above exemplary embodiment will be described.

(Sheet Sensor)

Figure 18:
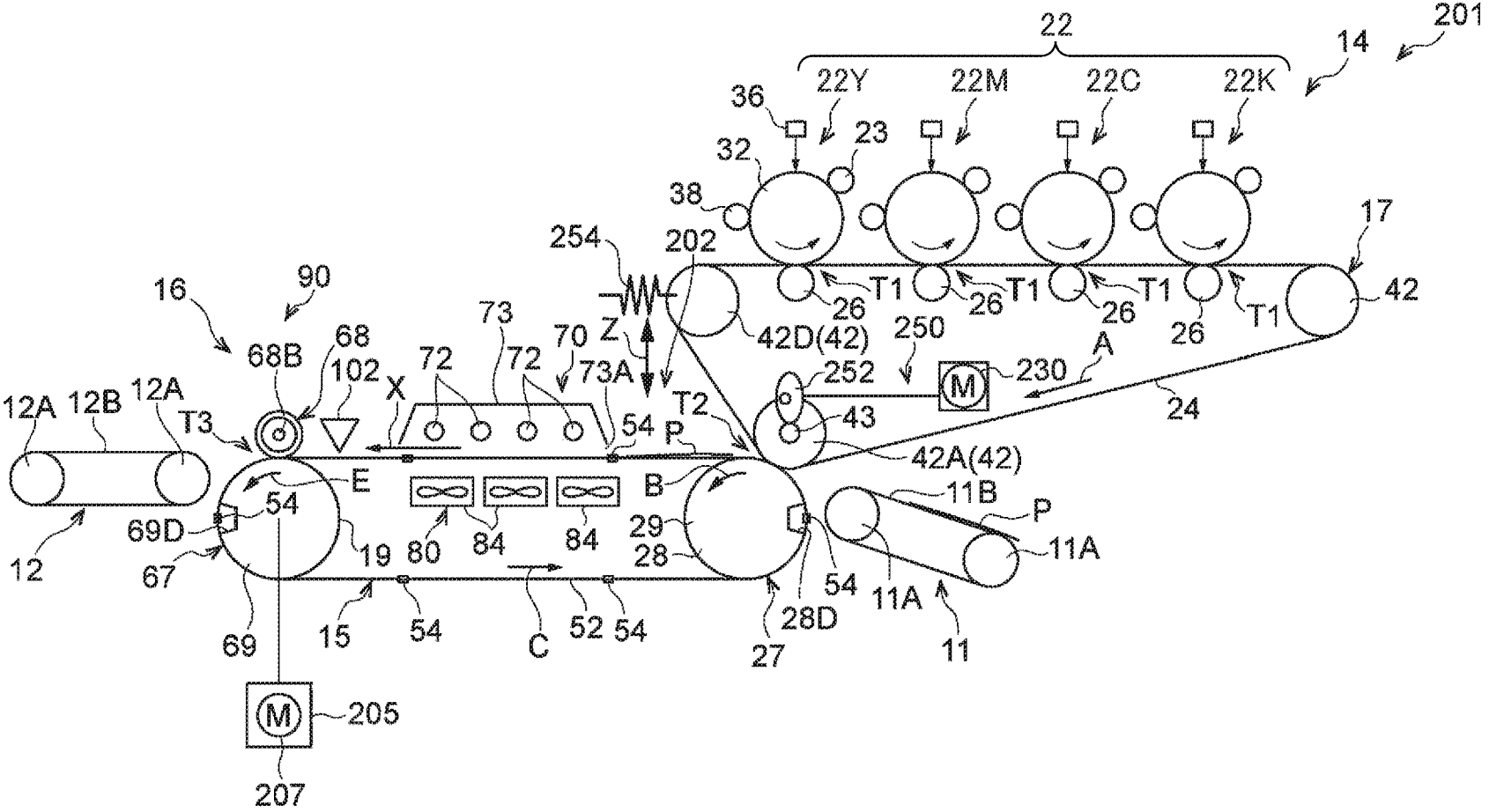
FIG. 18 is a schematic view of the image forming apparatus according to the second modification of the second exemplary embodiment.

In an image forming apparatus 201 according to the third modification shown in FIG. 18, the sheet sensor 102 is provided on the upstream side of the recording medium P of the fixing device 16 in the transport direction and on the downstream side of the non-contact heating unit 70 in the transport direction. The sheet sensor 102 detects the recording medium P that is passed through the heating region of the non-contact heating unit 70.

[Operation at the Time of Abnormality Detection]

An operation of the image forming apparatus 201 according to the present modification when the abnormality detection device 99 detects an abnormality will be described.

Figure 19:
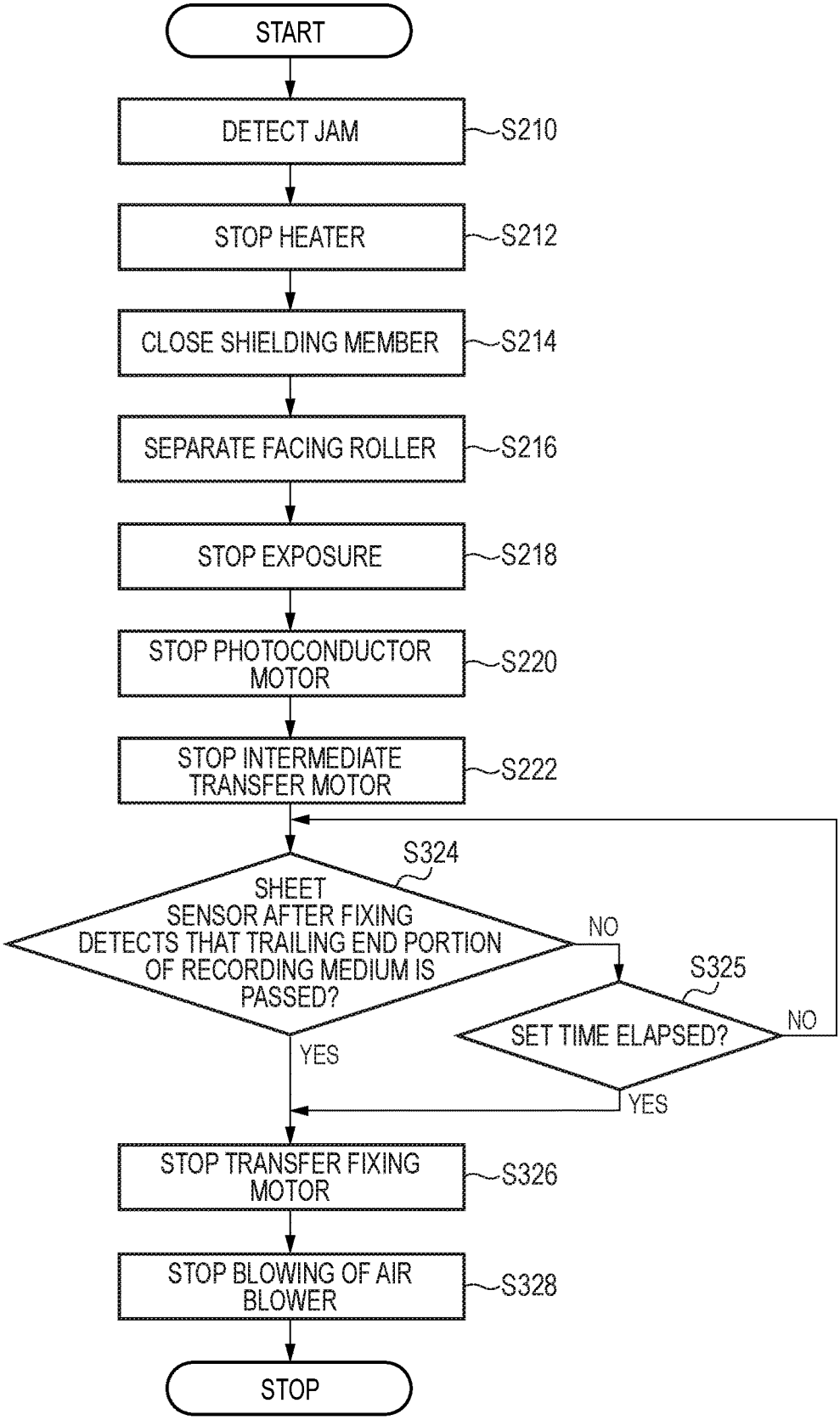
FIG. 19 is a flowchart of an operation at the time of abnormality detection of the image forming apparatus according to the second modification of the second exemplary embodiment.

FIG. 19 is a flowchart showing an example of a flow of the operation of the image forming apparatus 201 at the time of abnormality detection executed by the CPU (not shown) of the control device 204.

Steps S210 to S222 are the same as those in the above exemplary embodiment, and thus the description thereof will be omitted.

In step S324, it is determined whether the sheet sensor 102 provided on the upstream side of the fixing device 16 detects the trailing end portion of the recording medium P. When the trailing end portion of the recording medium P is not detected, the process proceeds to step S325. When the trailing end portion of the recording medium P is detected, the process proceeds to step S326.

When the abnormality detection device 99 detects an abnormality, the present operation is performed for the recording medium P on a most upstream side in a case where plural recording media P are present between the secondary transfer position T2 and the fixing region T3.

In step S325, it is determined whether a set time is elapsed from the abnormality detection. When the set time is not elapsed, the process returns to step S324. When the set time is elapsed, the process proceeds to step S326.

In step S326, the driving of the transfer fixing motor 207 is stopped. Then, in step S328, the air blowers 84 of the air blowing unit 80 are stopped. Step S326 and step S328 may be performed at the same time.

The rotational driving of the photoconductor drum 32 and the intermediate transfer belt 24 may be stopped at an early stage as compared with the case where the transfer cylinder 28 and the intermediate transfer belt 24 are in contact with each other until the rotational driving of the transfer cylinder 28 and the fixing cylinder 69 is stopped, and thus a load on the photoconductor drum 32 and the intermediate transfer belt 24 is reduced.

As for the recording medium P, the rotational driving of the transfer cylinder 28 and the fixing cylinder 69 is stopped after the trailing end portion of the recording medium P passes through the non-contact heating unit 70. Therefore, the heat received by the recording medium P from the non-contact heating unit 70 may be reduced as compared with the case of the rotational driving is stopped before the recording medium P passes through the heating region facing the non-contact heating unit 70.

As for the recording medium P, the blowing of the air blowers 84 of the air blowing unit 80 is stopped after the trailing end portion of the recording medium P passes through the heating region facing the non-contact heating unit 70. Therefore, the heating of the recording medium P by the non-contact heating unit 70 may be prevented as compared with the case where the blowing of the air blowers 84 of the air blowing unit 80 is stopped before the trailing end portion of the recording medium P passes through the heating region.

<Others>

The present invention is not limited to the above exemplary embodiments.

For example, in the above exemplary embodiments, the image forming apparatus is configured to transfer the toner image held by the intermediate transfer belt 24 as the example of the image holder and the intermediate transfer body to the recording medium P, but the present invention is not limited thereto. The image forming apparatus may be configured to transfer the toner image held by the photoconductor as an example of the image holder to the recording medium.

For example, in the above exemplary embodiments, when the abnormality detection device 99 detects an abnormality, the recording medium P is controlled not to be transported to the secondary transfer position T2 in the case where the recording medium P is present on the upstream side of the secondary transfer position T2, but the present invention is not limited thereto. The recording medium P on the upstream side of the secondary transfer position T2 may be transported, and the secondary transfer roller 127 and the intermediate transfer belt 24 may be relatively separated from each other after the trailing end of the recording medium P passes through the secondary transfer position T2.

The configuration of the image forming apparatus is not limited to the configuration of the above exemplary embodiments, and various configurations may be adopted. For example, an ink may be used as a colorant, and an inkjet method may be used as the colorant image former. Further, it is needless to say that the present invention may be implemented in various forms within a range not departing from the gist of the present invention.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The exemplary embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus, comprising:

a colorant image former;

an intermediate transfer belt configured to hold a colorant image formed by the colorant image former and to be rotationally driven;

a secondary transfer roller configured to transfer the colorant image onto a recording medium, which is transported from an upstream side, by sandwiching the recording medium between the secondary transfer roller and the intermediate transfer belt, and rotationally driving the secondary transfer roller to transport the recording medium to a downstream side;

a cam configured to relatively contact or separate the intermediate transfer belt and the secondary transfer roller by being driven by a motor;

a fixer configured to fix the colorant image on the recording medium on which the colorant image is transferred by the secondary transfer roller, and to be rotationally driven in interlocking with the secondary transfer roller to transport the recording medium to the downstream side;

a transfer cylinder that is provided at the secondary transfer roller;

a fixing cylinder that is provided at the fixer;

a chain that is wound around the transfer cylinder and the fixing cylinder, and configured to rotate in accordance with rotation of the transfer cylinder and the fixing cylinder; and a gripper that is provided at the chain, and configured to hold a leading end portion of the recording medium, and to transport the recording medium from the transfer cylinder to the fixing cylinder, wherein, in response to an abnormality being detected, the image forming apparatus operates in a mode in which the cam relatively separates the intermediate transfer belt and the secondary transfer roller, and then rotational driving of the secondary transfer roller is stopped after rotational driving of the intermediate transfer belt is stopped, rotational driving of the fixer is stopped in interlocking with the secondary transfer roller, holding of the leading end portion of the recording medium by the gripper is released after the recording medium is transported to the fixing cylinder, and in the mode, the rotational driving of the secondary transfer roller is stopped after the holding of the recording medium by the gripper is released.

2. The image forming apparatus according to claim 1, wherein, in the mode, the rotational driving of the secondary transfer roller is stopped after the leading end portion of the recording medium passes through the fixer.

3. The image forming apparatus according to claim 2, wherein, in the mode, the rotational driving of the secondary transfer roller is stopped in a state where the gripper disposed at the transfer cylinder is located in a range in which the chain is wound around the transfer cylinder.

4. The image forming apparatus according to claim 3, further comprising:

a non-contact heater that is provided between the secondary transfer roller and the fixer and configured to heat the colorant image transferred on the recording medium in a non-contact manner, wherein, in the mode, the rotational driving of the secondary transfer roller is stopped after a trailing end portion of the recording medium passes through a heating region where the recording medium faces the non-contact heater.

5. The image forming apparatus according to claim 2, wherein, in the mode, the rotational driving of the secondary transfer roller is stopped in a state in which the gripper disposed at the fixing cylinder is located in a range in which the chain is wound around the fixing cylinder excluding a fixing region of the fixer.

6. The image forming apparatus according to claim 5, further comprising:

a non-contact heater that is provided between the secondary transfer roller and the fixer and configured to heat the colorant image transferred on the recording medium in a non-contact manner, wherein, in the mode, the rotational driving of the secondary transfer roller is stopped after a trailing end portion of the recording medium passes through a heating region where the recording medium faces the non-contact heater.

7. The image forming apparatus according to claim 2, further comprising:

a non-contact heater that is provided between the secondary transfer roller and the fixer and configured to heat the colorant image transferred on the recording medium in a non-contact manner, wherein, in the mode, the rotational driving of the secondary transfer roller is stopped after a trailing end portion of the recording medium passes through a heating region where the recording medium faces the non-contact heater.

8. The image forming apparatus according to claim 1, wherein in the mode, the rotational driving of the secondary transfer roller is stopped in a state where the gripper disposed at the transfer cylinder is located in a range in which the chain is wound around the transfer cylinder.

9. The image forming apparatus according to claim 8, further comprising:

a non-contact heater that is provided between the secondary transfer roller and the fixer and configured to heat the colorant image transferred on the recording medium in a non-contact manner, wherein, in the mode, the rotational driving of the secondary transfer roller is stopped after a trailing end portion of the recording medium passes through a heating region where the recording medium faces the non-contact heater.

10. The image forming apparatus according to claim 1, wherein, in the mode, the rotational driving of the secondary transfer roller is stopped in a state in which the gripper disposed at the fixing cylinder is located in a range in which the chain is wound around the fixing cylinder excluding a fixing region of the fixer.

11. The image forming apparatus according to claim 10, further comprising:

a non-contact heater that is provided between the secondary transfer roller and the fixer and configured to heat the colorant image transferred on the recording medium in a non-contact manner, wherein, in the mode, the rotational driving of the secondary transfer roller is stopped after a trailing end portion of the recording medium passes through a heating region where the recording medium faces the non-contact heater.

12. The image forming apparatus according to claim 1, further comprising:

a non-contact heater that is provided between the secondary transfer roller and the fixer and configured to heat the colorant image transferred on the recording medium in a non-contact manner, wherein, in the mode, the rotational driving of the secondary transfer roller is stopped after a trailing end portion of the recording medium passes through a heating region where the recording medium faces the non-contact heater.

13. The image forming apparatus according to claim 12, further comprising:

an air blower that is provided to face the non-contact heater via the recording medium and configured to blow air to the recording medium, wherein, in the mode, blowing by the air blower is stopped after the trailing end portion of the recording medium passes through the heating region.

14. The image forming apparatus according to claim 1, wherein, in the mode, the rotational driving of the secondary transfer roller is stopped after a trailing end portion of the recording medium passes through the fixer.

* * * * *